US009617829B2

(12) United States Patent
Dale et al.

(10) Patent No.: US 9,617,829 B2
(45) Date of Patent: Apr. 11, 2017

(54) AUTONOMOUS DOWNHOLE CONVEYANCE SYSTEM

(75) Inventors: Bruce A. Dale, Sugar Land, TX (US); Randy C. Tolman, Spring, TX (US); Pavlin B. Entchev, Moscow (RU); Renzo Moises Angeles Boza, Houston, TX (US); Chris E. Shuchart, Missouri City, TX (US); Eric R. Grueschow, Houston, TX (US); Charles S. Yeh, Spring, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 574 days.

(21) Appl. No.: 13/989,728

(22) PCT Filed: Nov. 17, 2011

(86) PCT No.: PCT/US2011/061224

§ 371 (c)(1),
(2), (4) Date: May 24, 2013

(87) PCT Pub. No.: WO2012/082304

PCT Pub. Date: Jun. 21, 2012

(65) Prior Publication Data

US 2013/0248174 A1 Sep. 26, 2013

Related U.S. Application Data

(60) Provisional application No. 61/424,285, filed on Dec. 17, 2010, provisional application No. 61/552,747, filed on Oct. 28, 2011.

(51) Int. Cl.
*E21B 41/00* (2006.01)
*E21B 23/00* (2006.01)
(Continued)

(52) U.S. Cl.
CPC ..... *E21B 41/00* (2013.01); *E21B 23/00* (2013.01); *E21B 27/02* (2013.01); *E21B 29/06* (2013.01);
(Continued)

(58) Field of Classification Search
None
See application file for complete search history.

(56) References Cited

U.S. PATENT DOCUMENTS 2,080,875 A * 5/1937 Pitzer ..... C09K 8/536 166/299
2,543,823 A * 3/1951 Barry ..... E21B 43/1185 102/217
(Continued)

FOREIGN PATENT DOCUMENTS

WO WO 2011/149597 12/2011
WO WO 2011/150251 12/2011
WO WO 2012/082302 6/2012

*Primary Examiner* — Robert E Fuller
*Assistant Examiner* — Steven MacDonald
(74) *Attorney, Agent, or Firm* — ExxonMobil Upstream Research Company Law Dept.

(57) ABSTRACT

A tool assembly is provided that includes an actuatable tool such as a valve or a setting tool. And includes a location device that senses the location of the tool assembly within a tubular body based on a physical signature. The tool assembly also includes an on-board controller configured to send an activation signal to the actuatable tool when the location device has recognized a selected location of the tool based on the physical signature. The actuatable tool, the location device, and the on-board controller are together dimensioned and arranged to be deployed in the wellbore as an autonomous unit.

44 Claims, 22 Drawing Sheets

(51) Int. Cl.

| | |
|---|---|
| ***E21B 27/02*** | (2006.01) |
| ***E21B 29/06*** | (2006.01) |
| ***E21B 43/119*** | (2006.01) |
| ***E21B 43/14*** | (2006.01) |
| ***E21B 47/04*** | (2012.01) |
| ***E21B 43/25*** | (2006.01) |

(52) U.S. Cl.
CPC ..... *E21B 43/119* (2013.01); *E21B 43/14* (2013.01); *E21B 43/25* (2013.01); *E21B 47/04* (2013.01); *Y10T 137/1842* (2015.04)

(56) References Cited

U.S. PATENT DOCUMENTS 3,396,786 A 8/1968 Schuster et al.
4,187,909 A * 2/1980 Erbstoesser ..... E21B 27/02 137/268
4,194,561 A 3/1980 Stokley et al.
4,658,902 A 4/1987 Wesson et al.
5,361,838 A 11/1994 Kilgore
5,705,812 A 1/1998 Brewer et al.
5,909,774 A 6/1999 Griffith et al.
5,960,894 A * 10/1999 Lilly ..... E21B 43/117 166/297
6,056,055 A 5/2000 Falconer et al.
6,151,961 A 11/2000 Huber et al.
6,378,627 B1 * 4/2002 Tubel ..... E21B 4/18 166/250.01
6,394,184 B2 5/2002 Tolman et al.
6,513,599 B1 2/2003 Bixenman et al.
6,543,280 B2 4/2003 Duhon
6,543,538 B2 4/2003 Tolman et al.
6,581,689 B2 6/2003 Hailey, Jr.
6,601,646 B2 8/2003 Streich et al.
6,752,206 B2 6/2004 Watson et al.
6,789,623 B2 9/2004 Hill, Jr. et al.
6,817,410 B2 11/2004 Wetzel et al.
6,830,104 B2 12/2004 Nguyen et al.
6,843,317 B2 1/2005 Mackenzie
6,845,819 B2 1/2005 Barrett et al.
6,896,056 B2 5/2005 Mendez et al.
6,935,432 B2 8/2005 Nguyen
6,953,094 B2 10/2005 Ross et al.
6,983,796 B2 1/2006 Bayne et al.
6,997,263 B2 2/2006 Campbell et al.
7,055,598 B2 6/2006 Ross et al.
7,096,945 B2 8/2006 Richards et al.
7,100,691 B2 9/2006 Nguyen et al.
7,252,142 B2 8/2007 Brezinski et al.
7,264,061 B2 9/2007 Dybevik et al.
7,325,616 B2 2/2008 Lopez de Cardenas et al.
7,363,967 B2 4/2008 Burris, II et al.
7,367,395 B2 5/2008 Vidrine et al.
7,385,523 B2 6/2008 Thomeer et al.
7,407,007 B2 8/2008 Tibbles
7,431,085 B2 10/2008 Coronado et al.
7,431,098 B2 10/2008 Ohmer et al.
7,441,605 B2 10/2008 Coronado et al.
7,562,709 B2 7/2009 Saebi et al.
7,591,321 B2 9/2009 Whitsitt et al.
7,617,558 B2 11/2009 Boe
7,703,507 B2 4/2010 Strickland
7,814,970 B2 10/2010 Strickland
8,037,934 B2 10/2011 Strickland
8,162,051 B2 4/2012 Strickland
8,272,439 B2 9/2012 Strickland
2001/0054969 A1 12/2001 Thomeer et al.
2002/0093431 A1 7/2002 Zierolf
2003/0010495 A1 1/2003 Mendez et al.
2004/0007829 A1 1/2004 Ross
2004/0221993 A1 11/2004 Patterson et al.
2004/0239521 A1 12/2004 Zierolf
2005/0241824 A1 11/2005 Burris, II et al.
2005/0241835 A1 11/2005 Burris, II et al.
2005/0263287 A1 12/2005 Achee, Jr. et al.
2005/0269083 A1 12/2005 Burris, II et al.
2007/0056750 A1 3/2007 John et al.
2008/0053658 A1 3/2008 Wesson et al.
2008/0089175 A1 4/2008 Miszewski
2008/0125335 A1 5/2008 Bhavsar
2008/0142222 A1 6/2008 Howard et al.
2008/0196896 A1 8/2008 Bustos et al.
2008/0257546 A1 10/2008 Cresswell et al.
2009/0084556 A1 4/2009 Richards et al.
2009/0114392 A1 5/2009 Tolman et al.
2009/0120637 A1 5/2009 Kirkwood et al.
2009/0159279 A1 6/2009 Assal
2009/0248307 A1 10/2009 Barrow et al.
2009/0276094 A1 11/2009 De Guzman et al.
2009/0283279 A1 11/2009 Patel et al.
2009/0301723 A1 12/2009 Gray
2010/0122813 A1 * 5/2010 Trummer ..... E21B 33/138 166/255.1
2011/0035152 A1 2/2011 Durocher et al.
2011/0284227 A1 * 11/2011 Ayan ..... E21B 43/16 166/307
2011/0297369 A1 12/2011 Kumaran et al.

* cited by examiner

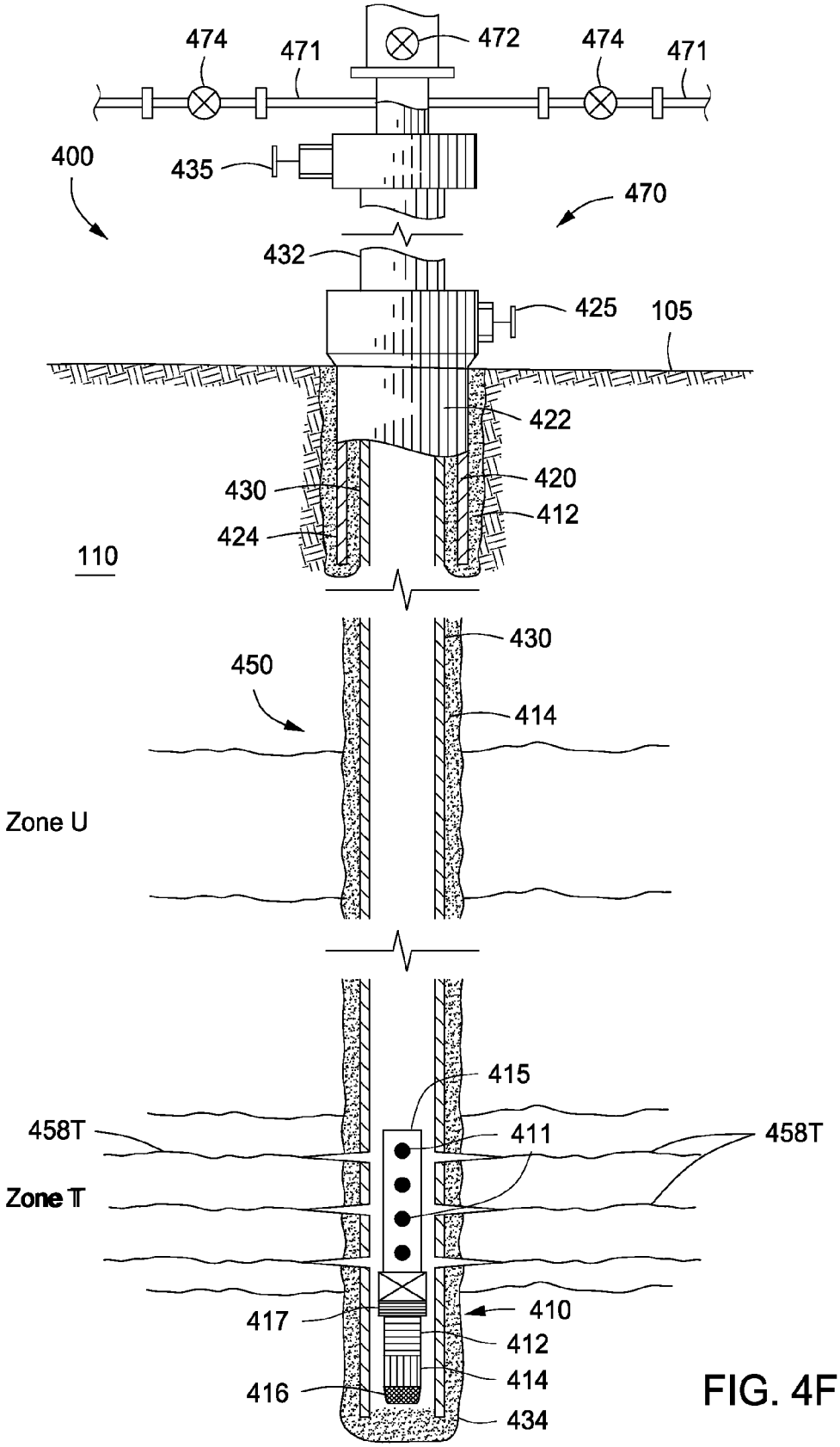
FIG. 4F1

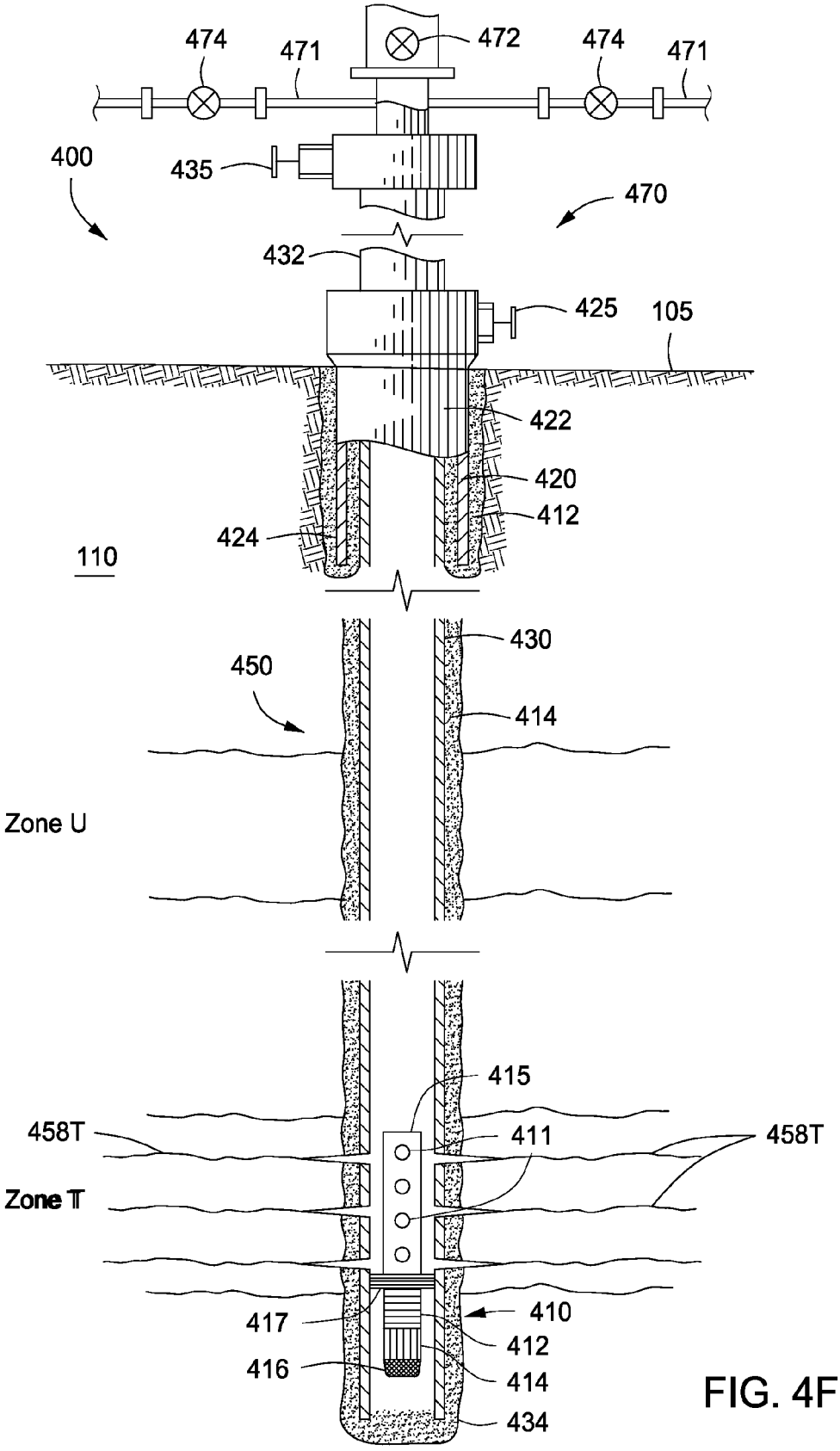
FIG. 4F2

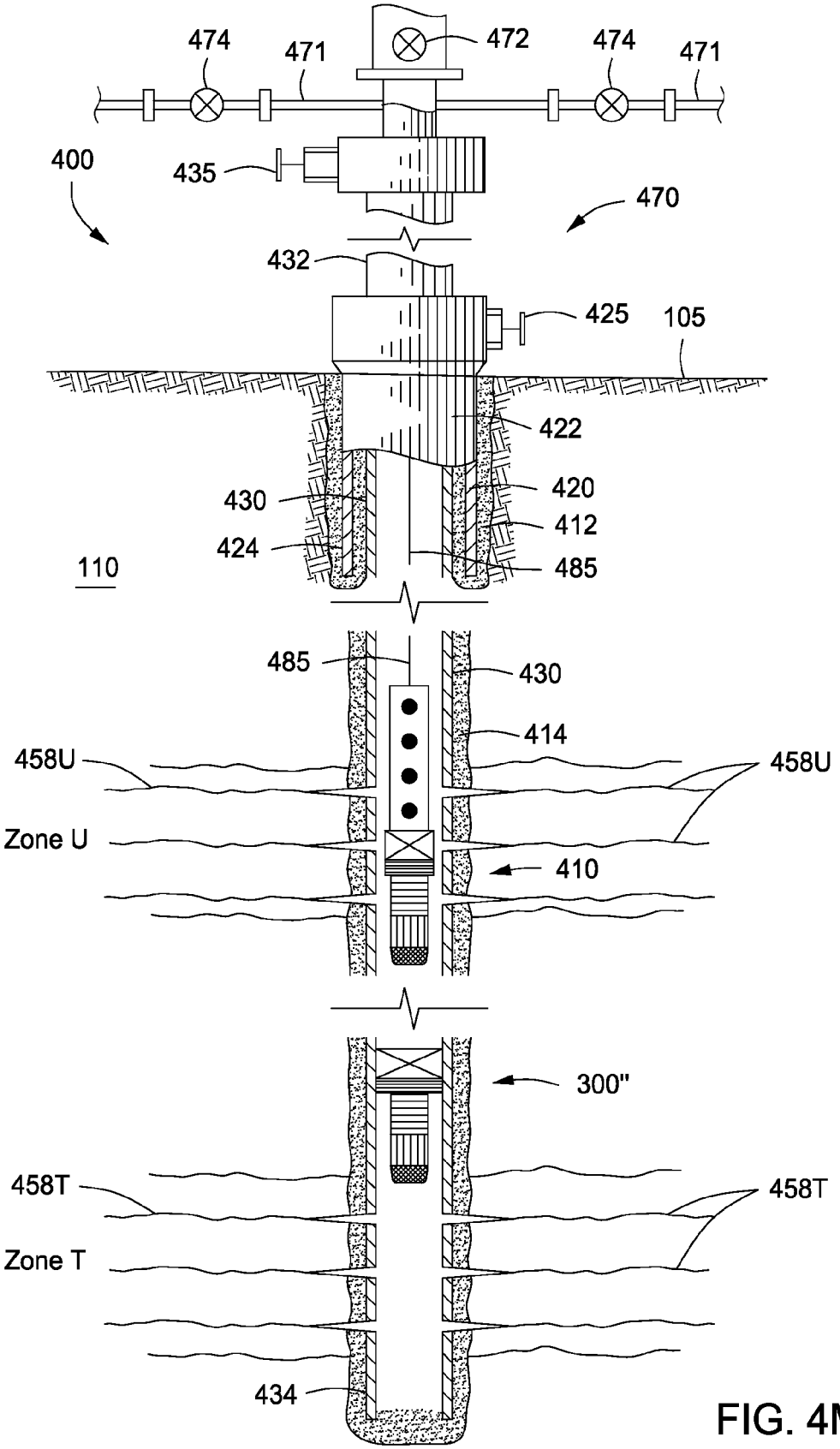
FIG. 4M1

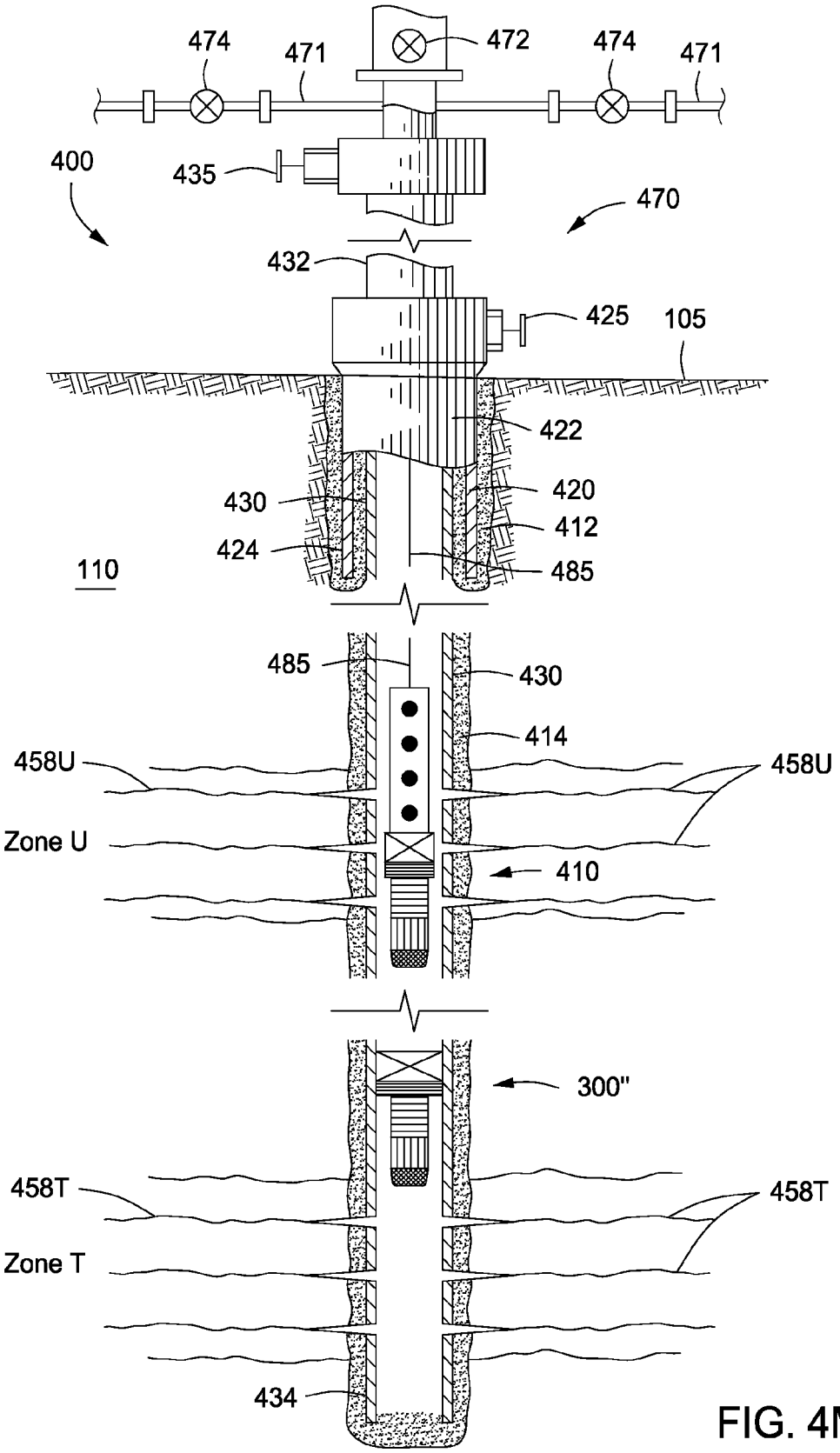
FIG. 4M2

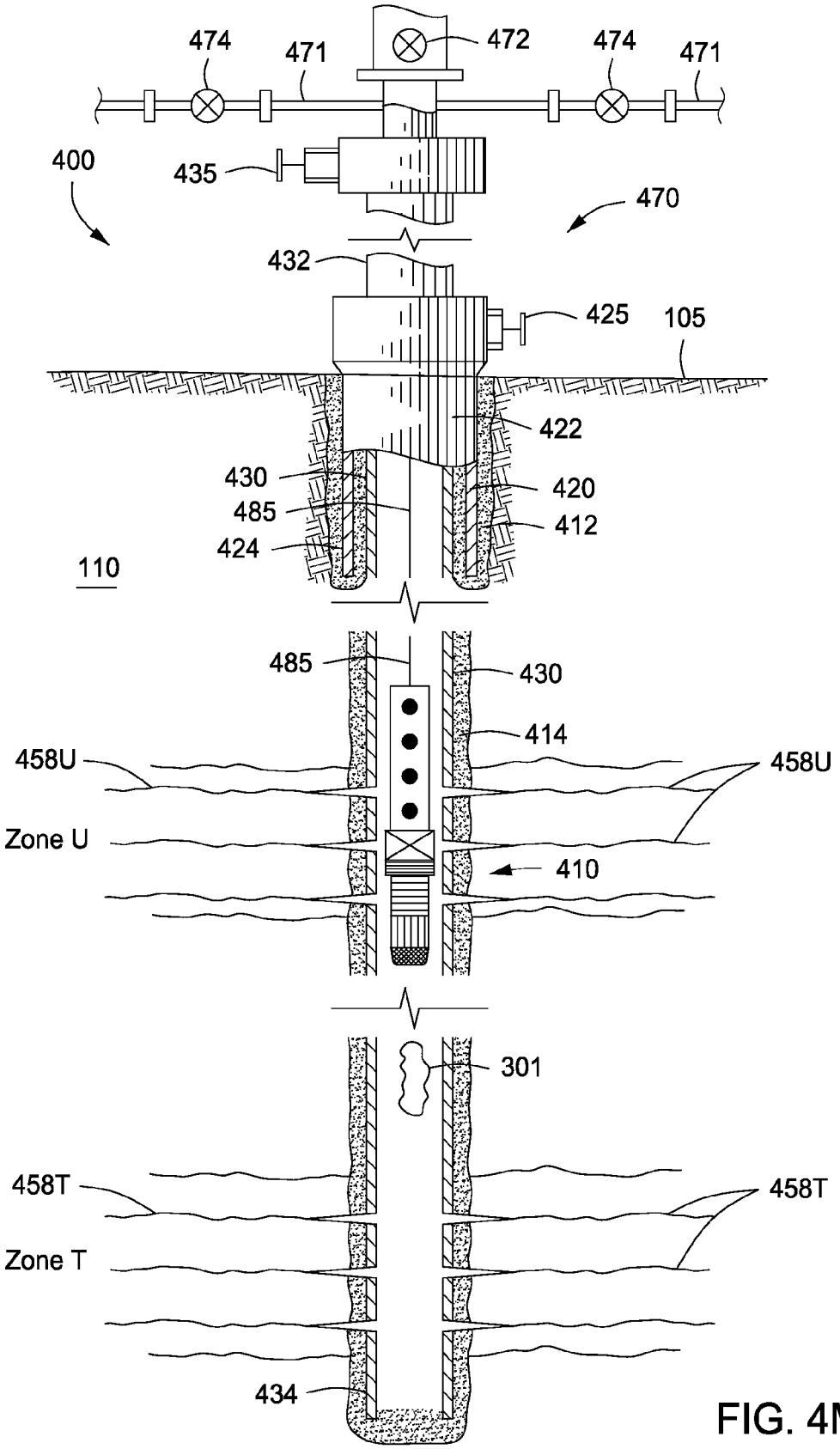
FIG. 4M3

AUTONOMOUS DOWNHOLE CONVEYANCE SYSTEM

CROSS REFERENCE TO RELATED APPLICATIONS

This application is the National Stage of International Application No. PCT/US11/61224, filed 17 Nov. 2011, which claims the benefit of U.S. Provisional Application No. 61/424,285, filed 17 Dec. 2010 and U.S. Provisional Application No. 61/552,747, filed 28 Oct. 2011, the entirety of which is incorporated herein by reference for all purposes.

BACKGROUND OF THE INVENTION

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

Field Of The Invention

This invention relates generally to the field of wellbore operations. More specifically, the invention relates to an autonomous conveyance system that is used to activate a downhole tool within a wellbore.

General Discussion Of Technology

In the drilling of oil and gas wells, a wellbore is formed using a drill bit that is urged downwardly at a lower end of a drill string. After drilling to a predetermined depth, the drill string and bit are removed and the wellbore is lined with a string of casing. An annular area is thus formed between the string of casing and the surrounding formations.

A cementing operation is typically conducted in order to fill or "squeeze" the annular area with columns of cement. The combination of cement and casing strengthens the wellbore and facilitates the zonal isolation of the formations behind the casing.

It is common to place several strings of casing having progressively smaller outer diameters into the wellbore. A first string may be referred to as a conductor pipe or surface casing. Such casing string serves to isolate and protect the shallower, fresh water-bearing aquifers from contamination by any other wellbore fluids. Accordingly, these casing strings are almost always cemented entirely back to the surface. The process of drilling and then cementing progressively smaller strings of casing is repeated several times until the well has reached total depth. In some instances, the final string of casing is a liner, that is, a string of casing that is not tied back to the surface. The final string of casing, referred to as a production casing, is also typically cemented into place.

As part of the completion process, the production casing is perforated at a desired level. This means that lateral holes are shot through the casing and the cement column surrounding the casing. The perforations allow hydrocarbon fluids to flow into the wellbore. Thereafter, the formation is typically fractured.

Hydraulic fracturing consists of injecting viscous fluids (usually shear thinning, non-Newtonian gels or emulsions) into a formation at such high pressures and rates that the reservoir rock parts and forms a network of fractures. The fracturing fluid is typically mixed with a granular proppant material such as sand, ceramic beads, or other granular materials. The proppant serves to hold the fracture(s) open after the hydraulic pressures are released. The combination of fractures and injected proppant increases the flow capacity of the treated reservoir.

In order to further stimulate the formation and to clean the near-wellbore regions downhole, an operator may choose to "acidize" the formations. This is done by injecting an acid solution down the wellbore and through the perforations. The use of an acidizing solution is particularly beneficial when the formation comprises carbonate rock. In operation, the drilling company injects a concentrated formic acid or other acidic composition into the wellbore, and directs the fluid into selected zones of interest. The acid helps to dissolve carbonate material, thereby opening up porous channels through which hydrocarbon fluids may flow into the wellbore. In addition, the acid helps to dissolve drilling mud that may have invaded the formation.

Application of hydraulic fracturing and acid stimulation as described above is a routine part of petroleum industry operations as applied to individual hydrocarbon-producing formations (or "pay zones"). Such pay zones may represent up to about 60 meters (100 feet) of gross, vertical thickness of subterranean formation. When there are multiple or layered formations to be hydraulically fractured, or a very thick hydrocarbon-bearing formation (over about 40 meters, or 131 feet), then more complex treatment techniques are required to obtain treatment of the entire target formation. In this respect, the operating company must isolate various zones or sections to ensure that each separate zone is not only perforated, but adequately fractured and treated. In this way the operator is sure that fracturing fluid and/or stimulant is being injected through each set of perforations and into each zone of interest to effectively increase the flow capacity at each desired depth.

The isolation of various zones for pre-production treatment requires that the intervals be treated in stages. This, in turn, involves the use of so-called diversion methods. In petroleum industry terminology, "diversion" means that injected fluid is diverted from entering one set of perforations so that the fluid primarily enters only one selected zone of interest. Where multiple zones of interest are to be perforated, this requires that multiple stages of diversion be carried out.

In order to isolate selected zones of interest, various diversion techniques may be employed within the wellbore. Known diversion techniques include the use of:

- Mechanical devices such as bridge plugs, packers, downhole valves, sliding sleeves, and baffle/plug combinations;
- Ball sealers;
- Particulates such as sand, ceramic material, proppant, salt, waxes, resins, or other compounds;
- Chemical systems such as viscosified fluids, gelled fluids, foams, or other chemically formulated fluids; and
- Limited entry methods.

These and other methods for temporarily blocking the flow of fluids into or out of a given set of perforations are described more fully in U.S. Pat. No. 6,394,184 entitled "Method and Apparatus for Stimulation of Multiple Formation Intervals", which issued in 2002.

The '184 patent also discloses various techniques for running a bottom hole assembly ("BHA") into a wellbore, and then creating fluid communication between the wellbore and various zones of interest. In most embodiments, the BHA includes various perforating guns having associated charges. In most embodiments, the BHA is deployed in the wellbore by means of a wireline extending from the surface. The wireline provides electrical signals to the perforating guns for detonation. The electrical signals allow the operator to cause the charges to detonate, thereby forming perforations.

The BHA also includes a set of mechanically actuated, axial position locking devices, or slips. The slips are actuated through a "continuous J" mechanism by cycling the axial load between compression and tension. In this way, the slips are re-settable.

The BHA further includes an inflatable packer or other sealing mechanism. The packer is actuated by application of a slight compressive load after the slips are set within the casing. Along with the slips, the packer is resettable so that the BHA may be moved to different depths or locations along the wellbore so as to isolate perforations along selected zones of interest.

The BHA also includes a casing collar locator. The casing collar locator initially allows the operator to monitor the depth or location of the assembly for appropriately detonating charges. After the charges are detonated (or the casing is otherwise penetrated for fluid communication with a surrounding zone of interest), the BHA is moved so that the packer may be set at a desired depth. The casing collar locator allows the operator to move the BHA to an appropriate depth relative to the newly formed perforations, and then isolate those perforations for hydraulic fracturing and chemical treatment.

Each of the various embodiments for a BHA disclosed in the '184 patent includes a means for deploying the assembly into the wellbore, and then translating the assembly up and down the wellbore. Such translation means include a string of coiled tubing, conventional jointed tubing, a wireline, an electric line or a tractor system attached directly to the BHA. In any instance, the purpose of the bottom hole assembly is to allow the operator to perforate the casing along various zones of interest, and then sequentially isolate the respective zones of interest so that fracturing fluid may be injected into the zones of interest in the same trip.

The bottom hole assembly and the formation treating processes disclosed in the '184 patent ("ACT-Frac" process) help to expedite the well completion process. In this respect, the operator is able to selectively set the slips and the packer for perforation and subsequent formation treatment. The operator is able to set the BHA at a first location, fracture or otherwise stimulate a formation, release the BHA, and move it to a new level along the wellbore, all without removing the BHA from the wellbore between stages.

However, as with previously-known well completion processes, the ACT-Frac process requires the use of expensive surface equipment. Such equipment may include a snubbing unit or a lubricator, which may extend as much as 75 feet above the wellhead. In this respect, the snubbing unit or the lubricator must be of a length greater than the length of the perforating gun assembly (or other tool string) to allow the perforating gun assembly to be safely deployed in the wellbore under pressure.

FIG. 1 presents a side view of a well site 100 wherein a well is being drilled. The well site 100 is using known surface equipment 50 to support wellbore tools (not shown) above and within a wellbore 10. The wellbore tools may be, for example, a perforating gun or a fracturing plug.

The illustrative surface equipment 50 first includes a lubricator 52. The lubricator 52 defines an elongated tubular device configured to receive wellbore tools (or a string of wellbore tools), and introduce them into the wellbore 10. The lubricator 52 delivers the tool string in a manner where the pressure in the wellbore 10 is controlled and maintained. With readily-available existing equipment, the height to the top of the lubricator 52 can be approximately 100 feet from an earth surface 105. Depending on the overall length requirements, other lubricator suspension systems (fit-for-purpose completion/workover rigs) may also be used. Alternatively, to reduce the overall surface height requirements, a downhole lubricator system similar to that described in U.S. Pat. No. 6,056,055 issued May 2, 2000 may be used as part of the surface equipment 50 and completion operations.

A wellhead 70 is provided above the wellbore 10 at the earth surface 105. The wellhead 70 is used to selectively seal the wellbore 10. During completion, the wellhead 10 includes various spooling components, sometimes referred to as spool pieces. The wellhead 70 and its spool pieces are used for flow control and hydraulic isolation during rig-up operations, stimulation operations, and rig-down operations.

The spool pieces may include a crown valve 72. The crown valve 72 is used to isolate the wellbore 10 from the lubricator 52 or other components above the wellhead 70. The spool pieces also include a lower master fracture valve 125 and an upper master fracture valve 135. These lower 125 and upper 135 master fracture valves provide valve systems for isolation of wellbore pressures above and below their respective locations. Depending on site-specific practices and stimulation job design, it is possible that one of these isolation-type valves may not be needed or used.

The wellhead 70 and its spool pieces may also include side outlet injection valves 74. The side outlet injection valves 74 provide a location for injection of stimulation fluids into the wellbore 10. The piping from surface pumps (not shown) and tanks (not shown) used for injection of the stimulation fluids are attached to the injection valves 74 using appropriate fittings and/or couplings.

The lubricator 52 is suspended over the wellbore 10 by means of a crane arm 54. The crane arm 54 is supported over the earth surface 105 by a crane base 56. The crane base 56 may be a working vehicle that is capable of transporting part or all of the crane arm 54 over a roadway. The crane arm 54 includes wires or cables 58 used to hold and manipulate the lubricator 52 into and out of position over the wellbore 10. The crane arm 54 and crane base 56 are designed to support the load of the lubricator 52 and any load requirements anticipated for the completion operations.

As an alternative to the crane arm 54 and crane based 56, a hydraulic suspension system may be used. This is more common for snubbing units.

In the view of FIG. 1, the lubricator 52 has been set down over the wellbore 10. An upper portion of an illustrative wellbore 10 is seen. The wellbore 10 defines a bore 5 that extends from the surface 105 of the earth, and into the earth's subsurface 110.

The wellbore 10 is first formed with a string of surface casing 20. The surface casing 20 has an upper end 22 in sealed connection with the lower master fracture valve 125. The surface casing 20 also has a lower end 24. The surface casing 20 is secured in the wellbore 10 with a surrounding cement sheath 25.

The wellbore 10 also includes a string of production casing 30. The production casing 30 is also secured in the wellbore 10 with a surrounding cement sheath 35. The production casing 30 has an upper end 32 in sealed connection with the upper master fracture valve 135. The production casing 30 also has a lower end (not shown). It is understood that the depth of the wellbore 10 preferably extends some distance below a lowest zone or subsurface interval to be stimulated to accommodate the length of the downhole tool, such as a perforating gun assembly.

Referring again to the surface equipment 50, the surface equipment 50 also includes a wireline 85. The wireline 85 runs over a pulley and then down through the lubricator 52, and supports the downhole tool (not shown). To protect the wireline 85, the wellhead 70 may include a wireline isolation tool 76. The wireline isolation tool 76 provides a means to guard the wireline 85 from direct flow of proppant-laden fluid injected into the side outlet injection valves 74 during a formation fracturing procedure.

The surface equipment 50 is also shown with a blow-out preventer 60. The blow-out preventer 60 is typically remotely actuated in the event of operational upsets. The lubricator 52, the crane arm 54, the crane base 56, the wireline 85, and the blow-out preventer 60 (and their associated ancillary control and/or actuation components) are standard equipment known to those skilled in the art of well completion.

It is understood that the various items of surface equipment 50 and components of the wellhead 70 are merely illustrative. A typical completion operation will include numerous valves, pipes, tanks, fittings, couplings, gauges, pumps, and other devices. Further, downhole equipment may be run into and out of the wellbore using an electric line, coiled tubing, or a tractor. Alternatively, a drilling rig or other platform may be employed, with jointed working tubes being used.

The use of a crane and suspended lubricator add expense and complexity to a well completion operation, thereby lowering the overall economics of a well-drilling project. Further, cranes and wireline equipment present on location occupy needed space. Accordingly, the inventors have conceived of downhole tools that may be deployed within a wellbore without a lubricator and a crane arm. Such downhole tools include a perforating gun and a bridge plug. Such downhole tools are autonomous, meaning that they are not necessarily mechanically controlled from the surface, and do not receive an electrical signal from the surface. Beneficially, such tools may be used for perforating and treating multiple intervals along a wellbore without being limited by pump rate or the need for an elongated lubricator.

The first patent application, U.S. application Ser. No.13/697,769, filed Nov. 13, 2012, which published as W02011/149597 and W02011/150251 describes the design and operation of certain autonomous tools. That application is titled "Assembly And Method For Multi-Zone Fracture Stimulation of A Reservoir Using Autonomous Tubular Units." In the application, a tool assembly is first provided. The tool assembly is intended for use in performing a tubular operation. In one embodiment, the tool assembly comprises an actuatable tool. The actuatable tool may be, for example, a fracturing plug, a bridge plug, a cutting tool, a casing patch, a cement retainer, or a perforating gun.

The tool assembly preferably self-destructs in response to a designated event. Thus, where the tool is a fracturing plug, the tool assembly may self-destruct within the wellbore at a designated time after being set. Where the tool is a perforating gun, the tool assembly may self-destruct as the gun is being fired upon reaching a selected level or zone of interest.

The tool assembly also includes a location device. The location device is designed to sense the location of the actuatable tool within a tubular body. The tubular body may be, for example, a wellbore constructed to produce hydrocarbon fluids, or a pipeline for the transportation of fluids.

The location device senses location within the tubular body based on a physical signature provided along the tubular body. In one arrangement, the location device is a casing collar locator, and the physical signature is formed by the spacing of collars along the tubular body. The collars are sensed by the collar locator. In another arrangement, the location device is a radio frequency antenna, and the physical signature is formed by the spacing of identification tags along the tubular body. The identification tags are sensed by the radio frequency antenna.

The tool assembly also comprises an on-board controller. The controller is designed to send an actuation signal to the actuatable tool when the location device has recognized a selected location of the tool. The location is again based on the physical signature along the wellbore. The actuatable tool, the location device, and the on-board controller are together dimensioned and arranged to be deployed in the tubular body as an autonomous unit.

The technology disclosed in the application addresses the autonomous deployment of certain mechanical tools. However, a need remains for an autonomous conveyance system for delivering chemicals or other fluids to a selected location downhole. Further, a need exists for the actuation of other mechanical tools, such as a whipstock without use of an electric line, or even without need of a lubricator and a crane arm.

SUMMARY OF THE INVENTION

The assemblies described herein have various benefits in the conducting of oil and gas exploration and production activities.

A delivery assembly for performing a wellbore operation is first disclosed. The delivery assembly is preferably a fluid delivery assembly. The fluid delivery assembly fundamentally includes an elongated fluid container. The fluid container is configured to hold a fluid. The fluid may be a primarily gaseous fluid such oxygen or air. Alternatively, the fluid may be a chemical used for treating or inhibiting waxes, hydrates, or scale along a pipe. Alternatively still, the fluid may be a chemical used for treating a formation, such as an acid or a resin.

The fluid delivery assembly also includes at least one actuatable tool. The actuatable tool may include a setting tool for setting a set of slips. The slips hold the fluid delivery assembly at a specified location within the wellbore. Alternatively or in addition, the actuatable tool may be a valve having one or more flow ports for releasing fluid from the fluid container. Thus, the fluid delivery assembly may be designed to release fluid from the fluid container in response to an actuation signal when the slips are set.

The fluid delivery assembly also has a location device. The location device generally senses the location of the actuatable tool within a wellbore. Sensing is based on a physical signature provided along the wellbore. For example, the location device may be a casing collar locator that identifies collars by detecting magnetic anomalies along a casing wall. In this instance, the physical signature is formed by the spacing of collars along a string of casing, with the collars being sensed by the collar locator.

Alternatively, the location device may be a radio frequency antenna that detects the presence of RFID tags spaced along or within the casing wall. In this instance, the physical signature is formed by the spacing of identification tags along a string of casing, with the identification tags being sensed by the radio frequency antenna.

In one embodiment, the location device comprises a pair of sensing devices spaced apart along the fluid delivery assembly. The sensing devices represent lower and upper sensing devices. The controller then comprises a clock that determines time that elapses between sensing by the lower sensing device and sensing by the upper sensing device as the assembly traverses across a physical signature marker. The fluid delivery assembly is programmed to determine tool assembly velocity at a given time based on the distance between the lower and upper sensing devices, divided by the elapsed time between sensing. In this way, location of the actuatable tool can be calculated relative to the physical signature provided by downhole markers.

The fluid delivery assembly further includes an on-board controller. The on-board controller is configured to send an actuation signal to at least one of the at least one actuatable tool when the location device has recognized a selected location of the tool based on the physical signature. Preferably, the on-board controller is part of an electronic module comprising onboard memory and built-in logic.

In one embodiment, one of the actuatable tools is a detonator. In this instance, the electronic module is configured to send a signal that initiates detonation of the fluid delivery assembly. This may take place when the assembly has reached the specified location. In this instance, detonation of the fluid delivery assembly itself serves to release the fluid. Alternatively, detonation may take place a designated time after the slips have been set and flow ports have opened to release fluids into the wellbore.

The tool assembly may also include a battery pack for providing power to the location device and the on-board controller.

The fluid container, the at least one actuatable tool, the location device, the battery pack, and the on-board controller are together dimensioned and arranged to be deployed in the wellbore as an autonomous unit. This means that the tool assembly does not rely upon a signal from the surface to know when to activate the tool. Preferably, the tool assembly is released into the wellbore without a working line. The tool assembly either falls gravitationally into the wellbore, or is pumped downhole. However, a non-electric working line such as slickline may optionally be employed. The slickline may be used to retrieve the fluid delivery assembly after fluid has been released from the fluid container.

In an alternative embodiment, the delivery system is a solids delivery assembly. In this arrangement, the assembly uses a canister for holding a solid material. The solid material may be, for example, ball sealers or other solids used for diversion. Alternatively, the solid may form a plug for isolation. Alternatively still, the solid may be an ignitable material used for stimulation.

In this arrangement, the delivery assembly is designed to release the solid from the canister in response to the release signal. In one aspect, the canister is fabricated from a friable material, and the delivery assembly is constructed to self-destruct in response to the actuation signal. In another aspect, the delivery assembly further comprises a perforation gun for perforating a string of casing proximate the selected location. In this instance, one of the at least one actuatable tool comprises the perforating gun, such that perforating charges are fired at the selected location in response to the actuation signal. The controller is programmed to send the release signal before the actuation signal.

A method for delivering fluid to a subsurface formation is also provided herein. The method first includes releasing a fluid delivery assembly into a tubular body. The tubular body may be a wellbore having a string of casing along its length. The wellbore may be completed for the purpose of producing hydrocarbons from one or more subsurface formations. Alternatively, the wellbore may be completed for the purpose of injecting fluids into one or more subsurface formations, such as for pressure maintenance or sequestration.

The fluid delivery assembly is designed in accordance with the fluid delivery assembly described above. In this respect, the fluid delivery assembly includes an elongated fluid container, at least one actuatable tool, a location device for sensing the location of one of the at least one actuatable tool within the tubular body based on a physical signature provided along the tubular body, and an on-board controller. The on-board controller is configured to send an actuation signal to an actuatable tool when the location device has recognized a selected location of the tool based on the physical signature.

The fluid container, the location device, the actuatable tool, and the on-board controller are together dimensioned and arranged to be deployed in the tubular body as an autonomous unit. In one aspect, the fluid delivery assembly further comprises a set of slips for holding the fluid delivery assembly proximate the selected location. In this instance, the actuatable tool includes a setting tool for setting the slips, such that the set of slips is activated in response to the actuation signal.

The fluid container contains a fluid. The method then includes releasing fluid from the fluid container. Fluid is released at the selected location in response to a release signal.

The fluid may be air loaded into the chamber at substantially atmospheric pressure. In this instance, releasing fluid creates a "burp" of negative pressure within the wellbore. This may be beneficial when a wellbore is first completed. In this respect, the negative pressure will cause a sudden pull of fluids through perforations in the wellbore. This, in turn, will help clean out perforations and fracture tunnels in the near-wellbore region.

Alternatively, the fluid may be an acid or a surfactant. This is of benefit, for example, after a wellbore is drilled for cleaning up drilling mud along perforations and fracture tunnels. Other fluids may also be employed for performing other wellbore operations.

In one embodiment, the fluid delivery assembly is fabricated from a friable material, such as ceramic. In this instance, the fluid delivery assembly is designed to self-destruct in response to a detonation signal. Optionally, the fluid delivery assembly includes a detonator for providing the self-destruction. In this instance, destruction of the fluid delivery assembly causes the fluid container to no longer hold fluid, thereby releasing the fluid. In this way, the detonator may actually be one of the actuatable tools, and the detonation signal is the release signal. Alternatively, the fluid release signal may be sent from the controller prior to the detonation signal.

In another embodiment, the fluid delivery assembly further includes a valve having one or more flow ports. The on-board controller sends a signal to open the valve, thereby releasing the fluid. This may be done either with or without stopping the fluid delivery assembly using a set of slips. In the former instance, the method further includes sending a signal to open the valve.

A whipstock assembly is also provided herein. The whipstock assembly is also designed as an autonomous tool that is dimensioned to be received in a wellbore. The whipstock assembly also includes an actuatable tool, a location device, and an on-board controller. However, instead of carrying a fluid container, the whipstock assembly carries a whipstock.

The whipstock has an elongated concave face. The concave face diverts a milling bit against the surrounding casing in order to form a window. Preferably, the whipstock is fabricated from a friable material such that the tool assembly self-destructs in response to a signal sent after a designated period of time.

The actuatable tool for the whipstock assembly is preferably a set of slips. The slips hold the whipstock assembly in place during the formation of the window along a string of casing. The slips are set at the specified or pre-programmed location in response to the actuation signal.

BRIEF DESCRIPTION OF THE DRAWINGS

So that the present inventions can be better understood, certain drawings, charts, graphs and/or flow charts are appended hereto. It is to be noted, however, that the drawings illustrate only selected embodiments of the inventions and are therefore not to be considered limiting of scope, for the inventions may admit to other equally effective embodiments and applications.

FIG. 4A is a side view of a well site having a wellbore for receiving autonomous tools. The wellbore is being completed in at least zones of interest "T" and "U."

FIG. 4F1 is another side view of the well site of FIG. 4A. Here, the wellbore has received an autonomous fluid delivery assembly, in one embodiment.

FIG. 4F2 is subsequent side view of the well site of FIG. 4F1. Here, the flow ports in a fluid container of the fluid delivery assembly have been opened, thereby releasing fluid into the wellbore adjacent the zone of interest "T."

FIG. 41 is yet another side view of the well site of FIG. 4A. Here, the wellbore has received a second perforating gun assembly.

FIG. 4M1 is yet another side view of the well site of FIG. 4A. Here, a second fluid conveyance assembly is being pumped downhole. The fluid conveyance assembly is shown in a pre-actuated position, and is tethered to the surface by means of an optional slickline.

FIG. 4M2 is a subsequent side view of the well site of FIG. 4M1. Here, the flow ports in a fluid container of the fluid delivery assembly have been opened, thereby releasing fluid into the wellbore adjacent the zone of interest "U."

FIG. 4M3 is still a subsequent side view of the well site of FIG. 4M1. Here, slips holding the fluid delivery assembly in place have been released, and the fluid delivery assembly is being raised back to the surface. A fracturing plug has been detonated below the zone of interest "U."

FIG. 4N provides a final side view of the well site of FIG. 4A. The wellbore is now receiving production fluids.

DETAILED DESCRIPTION OF CERTAIN EMBODIMENTS

Definitions

Figure 1:
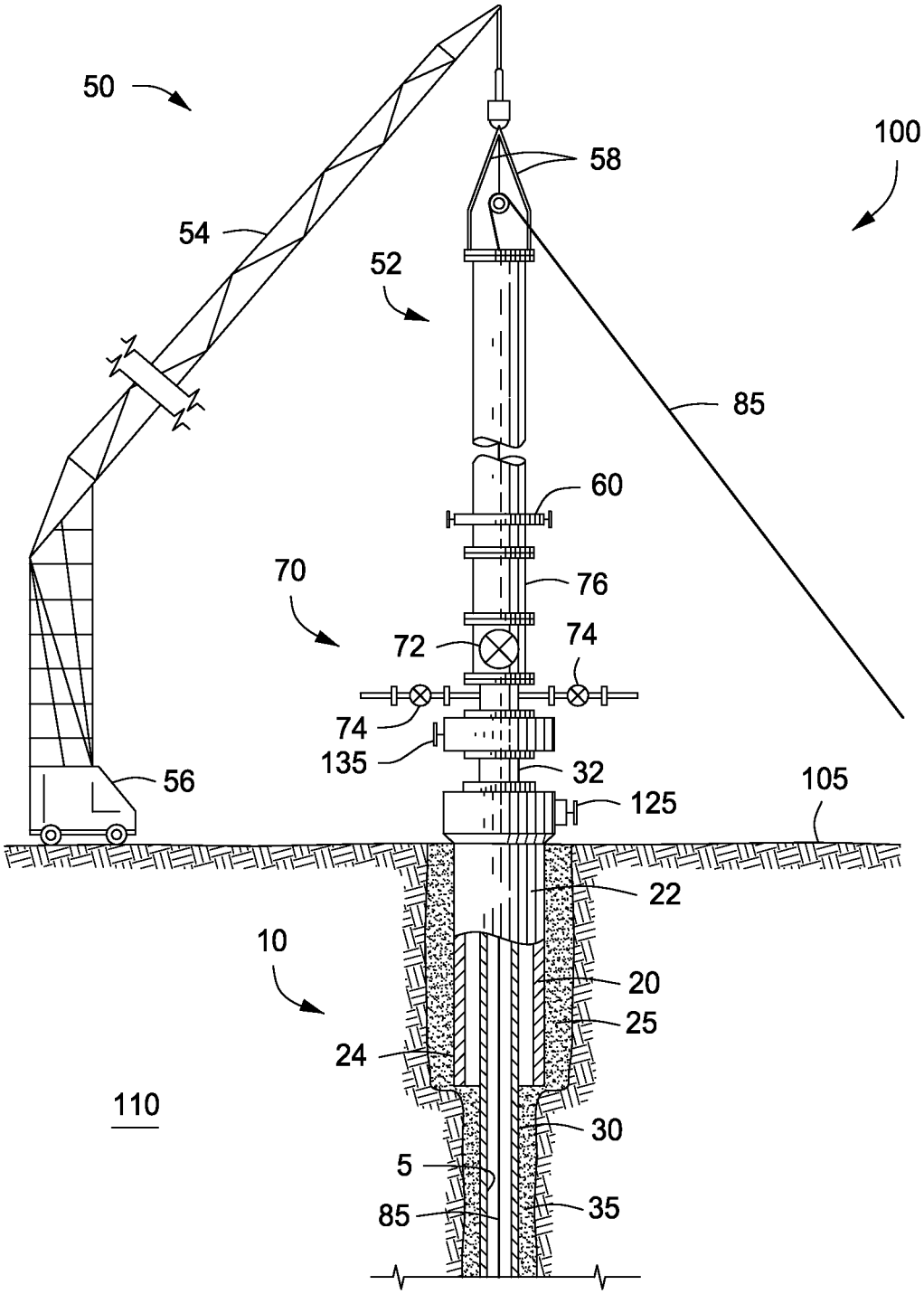
FIG. 1 (PRIOR ART)
FIG. 1 presents a presents a side view of a well site wherein a well is being completed. Known surface equipment is provided to support wellbore tools (not shown) above and within a wellbore. This is a depiction of the prior art.

As used herein, the term "hydrocarbon" refers to an organic compound that includes primarily, if not exclusively, the elements hydrogen and carbon. Hydrocarbons may also include other elements, such as, but not limited to, halogens, metallic elements, nitrogen, oxygen, and/or sulfur. Hydrocarbons generally fall into two classes: aliphatic, or straight chain hydrocarbons, and cyclic, or closed ring hydrocarbons, including cyclic terpenes. Examples of hydrocarbon-containing materials include any form of natural gas, oil, coal, and bitumen that can be used as a fuel or upgraded into a fuel.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions or at ambient conditions (15° C. and 1 atm pressure). Hydrocarbon fluids may include, for example, oil, natural gas, coalbed methane, shale oil, pyrolysis oil, pyrolysis gas, a pyrolysis product of coal, and other hydrocarbons that are in a gaseous or liquid state.

As used herein, the terms "produced fluids" and "production fluids" refer to liquids and/or gases removed from a subsurface formation, including, for example, an organic-rich rock formation. Produced fluids may include both hydrocarbon fluids and non-hydrocarbon fluids. Production fluids may include, but are not limited to, oil, natural gas, pyrolyzed shale oil, synthesis gas, a pyrolysis product of coal, carbon dioxide, hydrogen sulfide and water (including steam).

As used herein, the term "fluid" refers to gases, liquids, and combinations of gases and liquids, as well as to combinations of gases and solids, combinations of liquids and solids, and combinations of gases, liquids, and solids.

As used herein, the term "gas" refers to a fluid that is in its vapor phase at 1 atm and 15° C.

As used herein, the term "oil" refers to a hydrocarbon fluid containing primarily a mixture of condensable hydrocarbons.

As used herein, the term "subsurface" refers to geologic strata occurring below the earth's surface.

As used herein, the term "formation" refers to any definable subsurface region. The formation may contain one or more hydrocarbon-containing layers, one or more non-hydrocarbon containing layers, an overburden, and/or an underburden of any geologic formation.

The terms "zone" or "zone of interest" refers to a portion of a formation containing hydrocarbons. Alternatively, the formation may be a water-bearing interval.

For purposes of the present disclosure, the terms "ceramic" or "ceramic material" may include oxides such as alumina and zirconia. Specific examples include bismuth strontium calcium copper oxide, silicon aluminium oxynitrides, uranium oxide, yttrium barium copper oxide, zinc oxide, and zirconium dioxide. "Ceramic" may also include non-oxides such as carbides, borides, nitrides and silicides. Specific examples include titanium carbide, silicon carbide, boron nitride, magnesium diboride, and silicon nitride. The term "ceramic" also includes composites, meaning particulate-reinforced combinations of oxides and non-oxides. Additional specific examples of ceramics include barium titanate, strontium titanate, ferrite, and lead zierconate titanate.

For purposes of the present patent, the term "production casing" includes a liner string or any other tubular body fixed in a wellbore along a zone of interest.

The term "friable" means any material that is easily crumbled, powderized, or broken into very small pieces. The term "friable" includes frangible materials such as ceramic.

The term "millable" means any material that may be drilled or ground into pieces within a wellbore. Such materials may include aluminum, brass, cast iron, steel, ceramic, phenolic, composite, and combinations thereof.

As used herein, the term "wellbore" refers to a hole in the subsurface made by drilling or insertion of a conduit into the subsurface. A wellbore may have a substantially circular cross section, or other cross-sectional shapes. As used herein, the term "well", when referring to an opening in the formation, may be used interchangeably with the term "wellbore."

Description of Selected Specific Embodiments

The inventions are described herein in connection with certain specific embodiments. However, to the extent that the following detailed description is specific to a particular embodiment or a particular use, such is intended to be illustrative only and is not to be construed as limiting the scope of the inventions.

It is proposed herein to use tool assemblies for well-completion or other wellbore operations that are autonomous. In this respect, the tool assemblies do not require a wireline and need not otherwise be mechanically tethered or electronically connected to equipment external to the wellbore. The delivery method of a tool assembly may include gravity, pumping, and tractor delivery.

Various tool assemblies are therefore proposed herein that generally include:

- an actuatable tool;
- a location device for sensing the location of the actuatable tool within a tubular body based on a physical signature provided along the tubular body; and
- an on-board controller configured to send an activation signal to the actuatable tool when the location device has recognized a selected location of the tool based on the physical signature. The actuatable tool is designed to be actuated to perform a tubular operation in response to the activation signal.

The actuatable tool, the location device, the on-board controller, and perhaps a battery pack are together dimensioned and arranged to be deployed in a wellbore as an autonomous unit.

Figure 2:
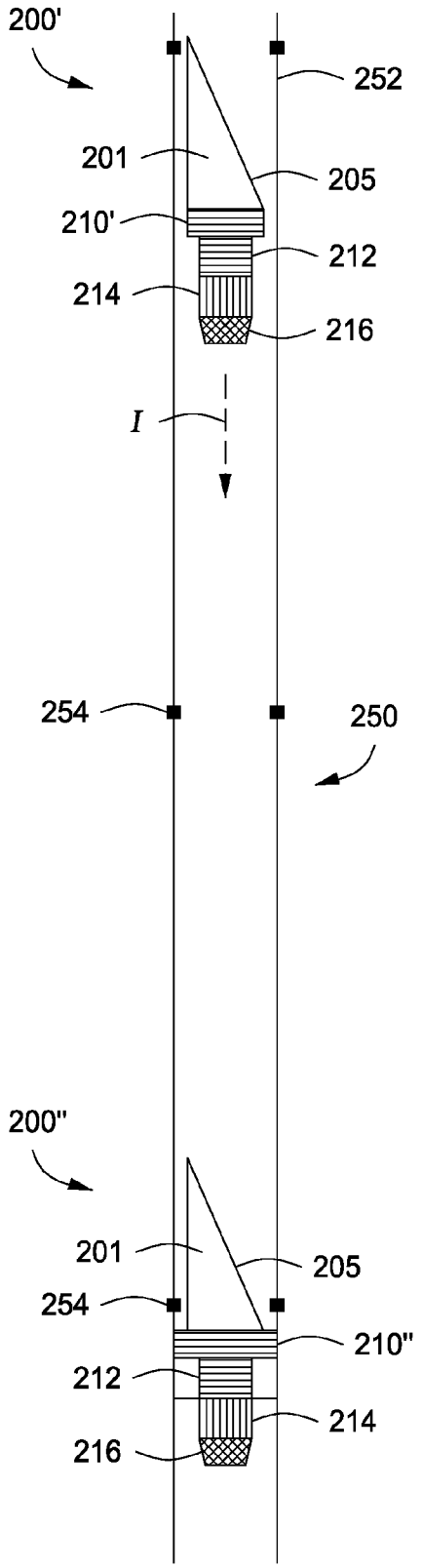
FIG. 2 is a side view of an autonomous tool as may be used for wellbore operations. In this view, the tool is a whipstock assembly deployed in a string of production casing. The whipstock assembly is shown in both a pre-actuated position and an actuated position.

FIG. 2 presents a side view of an illustrative autonomous tool 200 as may be used for wellbore operations. In this view, the tool 200 is a whipstock assembly deployed in a string of production casing 250. The production casing 250 is formed from a plurality of "joints" 252 that are threadedly connected at collars 254.

In FIG. 2, the whipstock assembly 200 is shown in both a pre-actuated position and an actuated position. The whipstock assembly is shown in a pre-actuated position at 200', and in an actuated position at 200". Arrow "I" indicates the movement of the whipstock assembly 200' in its pre-actuated position, down to a location in the production casing 250 where the whipstock assembly 200" is in its actuated position. The whipstock assembly will be described primarily with reference to its pre-actuated position, at 200'.

The whipstock assembly 200' first includes a whipstock 201. The whipstock 201 includes an angled and concave face 205. The concave face 205 is configured to receive a milling bit (not shown) for the formation of a window that will be formed in the casing 250.

The whipstock assembly 200' also includes an actuatable tool. In the preferred arrangement, the actuatable tool is a set of slips 210'. The slips 210' ride outwardly from the assembly 200' along wedges (not shown) spaced radially around the assembly 200'. The slips 210' may be urged outwardly along the wedges in response to a shift in a sleeve or other means as is known in the art. The slips 210' extend radially to "bite" into the casing 250 when actuated, as shown at 201". In this manner, the whipstock assembly 200" is secured in position.

The whipstock assembly 200' also includes a setting tool 212. The setting tool 212 will actuate the slips 210' and translate them along the wedges to contact the surrounding casing 250. In this embodiment, the term "actuatable tool" may refer to the slips 210', the setting tool 212, or both together.

The whipstock assembly 200' also includes a position locator 214. The position locator 214 serves as a location device for sensing the location of the tool assembly 200' within the production casing 250. More specifically, the position locator 214 senses the presence of objects or "tags" along the wellbore, and generates depth signals in response.

In the view of FIG. 2, the objects 254 are the casing collars. This means that the position locator 214 is a casing collar locator, known in the industry as a "CCL." The CCL senses the location of the casing collars 254 as it moves down the production casing 250. While FIG. 2 presents the position locator 214 as a CCL and the objects 254 as casing collars, it is understood that other sensing arrangements may be employed in the whipstock assembly 200'. For example, the position locator 214 may be a radio frequency detector, and the objects 254 may be radio frequency identification tags, or "RFID" devices. In this arrangement, the tags may be placed along the inner diameters of selected casing joints 252, and the position locator 214 will define an RFID antenna/reader that detects the RFID tags. Alternatively, the position locator 214 may be both a casing collar locator and a radio frequency antenna. The radio frequency tags may be placed, for example, every 500 feet or every 1,000 feet to assist a casing collar locator algorithm.

A special tool-locating algorithm may be employed for accurately tracking casing collars. U.S. Provisional Pat. Appl. No. 61/424,285 filed on Dec. 27, 2010, which published as WO2012/082302, discloses a method of actuating a downhole tool in a wellbore. This patent application is entitled "Method for Automatic Control and Positioning of Autonomous Downhole Tools."

The method first includes acquiring a CCL data set from the wellbore. This is preferably done using a traditional casing collar locator. Casing collar locators are run into a wellbore on a wireline or electric line to detect magnetic anomalies along the casing string. The CCL data set correlates continuously recorded magnetic signals with measured depth. More specifically, the depths of casing collars may be determined based on the length and speed of the wireline pulling a CCL logging device. In this way, a first CCL log for the wellbore is formed.

The method also includes selecting a location within the wellbore for actuation of an actuatable tool. In the whipstock assembly 200', the actuatable tool is preferably a set of slips 210 that are part of or are actuated by the setting tool 212. The actuatable tool may optionally also include an elastomeric sealing element (not shown).

The method further comprises downloading the first CCL log into a processor. The processor is part of an on-board controller, which in turn is part of an autonomous tool assembly.

As shown in FIG. 2, the whipstock assembly 200' includes an on-board controller 216. The on-board controller 216 processes the depth signals generated by the position locator 214. The processing may be in accordance with any of the methods disclosed in U.S. Ser. No. 61/424,285. In one aspect, the on-board controller 216 compares the generated signals from the position locator 214 with a pre-determined physical signature obtained for wellbore objects from the prior CCL log.

The on-board controller 216 is programmed to continuously record magnetic signals as the autonomous tool 200' traverses the casing collars 254. In this way, a second CCL log is formed. The processor, or on-board controller 216, transforms the recorded magnetic signals of the second CCL log by applying a moving windowed statistical analysis. Further, the processor incrementally compares the transformed second CCL log with the first CCL log during deployment of the downhole tool to correlate values indicative of casing collar locations. This is preferably done through a pattern matching algorithm. The algorithm correlates individual peaks or even groups of peaks representing casing collar locations. In addition, the processor is programmed to recognize the selected location in the wellbore, and then send an activation signal to the actuatable wellbore device or tool when the processor has recognized the selected location.

In some instances, the operator may have access to a wellbore diagram providing exact information concerning the spacing of downhole markers such as the casing collars 254. The on-board controller 216 may then be programmed to count the casing collars 254, thereby determining the location of the tool as it moves downwardly in the wellbore.

In some instances, the production casing 250 may be pre-designed to have so-called short joints, that is, selected joints that are only, for example, 15 feet, or 20 feet, in length, as opposed to the "standard" length selected by the operator for completing a well, such as 30 feet. In this event, the on-board controller 216 may use the non-uniform spacing provided by the short joints as a means of checking or confirming a location in the wellbore as the whipstock assembly 200' moves through the production casing 250.

In one embodiment, the method further comprises transforming the CCL data set for the first CCL log. This also is done by applying a moving windowed statistical analysis. The first CCL log is downloaded into the processor as a first transformed CCL log. In this embodiment, the processor incrementally compares the second transformed CCL log with the first transformed CCL log to correlate values indicative of casing collar locations.

In the above embodiments, applying a moving windowed statistical analysis preferably comprises defining a pattern window size for sets of magnetic signal values, and then computing a moving mean $m(t+1)$ for the magnetic signal values over time. The moving mean $m(t+1)$ is preferably in vector form, and represents an exponentially weighted moving average for the magnetic signal values for the pattern windows. Applying a moving windowed statistical analysis then further comprises defining a memory parameter p for the windowed statistical analysis, and calculating a moving covariance matrix $\Sigma(t+1)$ for the magnetic signal values over time.

Additional details for the tool-locating algorithm are disclosed in U.S. Provisional Pat. Appl. No. 61/424,285, referenced above. That related, co-pending application is incorporated by reference herein in its entirety.

In one embodiment, the position locator 214 comprises an accelerometer (not shown). An accelerometer is a device that measures acceleration experienced during a freefall. An accelerometer may include multi-axis capability to detect magnitude and direction of the acceleration as a vector quantity. When in communication with analytical software, the accelerometer allows the position of an object to be determined. Preferably, the position locator would also include a gyroscope. The gyroscope would help maintain the orientation of the fracturing plug assembly 200' as it traverses the wellbore.

In any event, the method further includes sending an activation signal. In the arrangement of FIG. 2, this is done when the on-board controller 216 determines that the whipstock assembly 200' (or a specific component therein) has arrived at a particular depth adjacent a selected zone of interest. In the example of FIG. 2, the on-board controller 216 activates the slips 210" (through the setting tool 212) to stop the whipstock assembly 200' from moving and to set the tool 200" in the production casing 250 at a desired depth or location.

It is noted that the whipstock assembly 200" is autonomous, meaning that it is not electrically controlled from the surface for receiving the activation signal.

Figure 3:
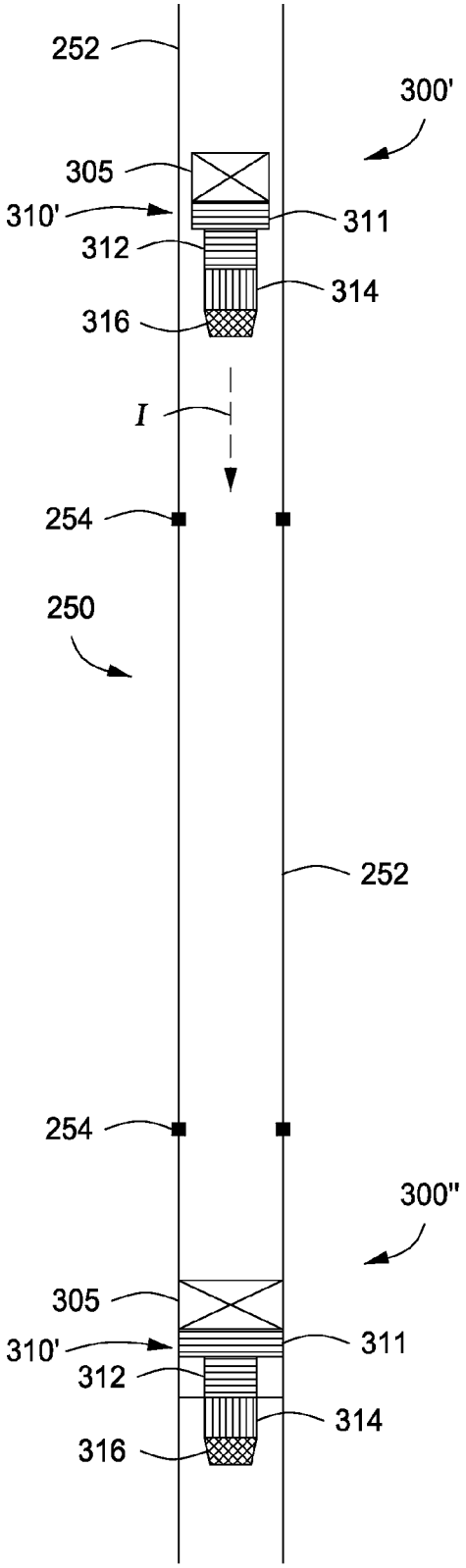
FIG. 3 is a side view of an autonomous tool as may be used for wellbore operations, in an alternate embodiment. In this view, the tool is a fracturing plug deployed in a string of production casing. The plug is shown in both a pre-actuated position and an actuated position.

Other arrangements for an autonomous tool besides the whipstock assembly 200 may be used. FIG. 3 presents a side view of a fracturing plug assembly 300. The fracturing plug assembly 300 is also shown within the string of production casing 250.

In FIG. 3, the fracturing plug assembly 300 is shown in both a pre-actuated position and an actuated position. The fracturing plug assembly is shown in a pre-actuated position at 300', and in an actuated position at 300". Arrow "I" indicates the movement of the fracturing plug assembly 300' in its pre-actuated position, down to a location in the production casing 250 where the fracturing plug assembly 300" is in its actuated position. The fracturing plug assembly will be described primarily with reference to its pre-actuated position, at 300'.

The fracturing plug assembly 300' first includes a plug body 310'. The plug body 310' will preferably define an elastomeric sealing element 305. The sealing element 305 is mechanically expanded in response to a shift in a sleeve or other means as is known in the art. In one embodiment, the plug body 305' is actuated by squeezing the sealing element 305 using a sleeve or sliding ring; in another aspect, the plug body 305' is actuated by forcing the sealing element 305 outwardly along wedges (not shown).

The plug body 310' may also include a set of slips 311. The slips 311 ride outwardly from the assembly 300' along wedges (not shown) spaced radially around the assembly 300'. Preferably, the slips 311 are also urged outwardly along the wedges in response to a shift in the same sleeve or other means as the sealing element 305. The slips 311 extend radially to "bite" into the casing 250 when actuated, securing the plug assembly 300" in position. Examples of existing plugs with suitable slip designs are the Smith Copperhead Drillable Bridge Plug and the Halliburton Fas Drill® Frac Plug.

The fracturing plug assembly 300' also includes a setting tool 312. The setting tool 312' will actuate the sealing element 305 and slips 311 and translate them along the wedges to contact the surrounding casing 250.

In the actuated position for the plug assembly 300", the plug body 310" is shown in an expanded state. In this respect, the elastomeric sealing element 305 is expanded into sealed engagement with the surrounding production casing 250, and the slips 311 are expanded into mechanical engagement with the surrounding production casing 250. Thus, in the tool assembly 300", the plug body 305" consisting of the sealing element 305 and the slips 311 defines an actuatable tool. The setting tool 312 may also be considered as part of the actuatable tool.

As with the whipstock assembly 200 of FIG. 2, the fracturing plug assembly 300 also includes a position locator 314 and an on-board controller 316. These serve the same function as the position locator 214 and the on-board controller 216 of FIG. 2. A special tool-locating algorithm is again employed for accurately tracking casing collars or other tags. An activation signal is sent from the on-board controller 316 to actuate the plug body 310" at a specified location in the wellbore. In this way, the downhole tool 300 is autonomous, meaning that it is not electrically controlled from the surface for receiving the activation signal.

Other mechanical devices may be configured as an autonomous tool. Such devices include a bridge plug, a cutting tool, a casing patch, a cement retainer, and a perforating gun. Such autonomous tools are discussed further in U.S. Provisional Pat. Appl. No. 61/348,578 filed on 26 May 2010, referenced and incorporated above.

Figure 4A:
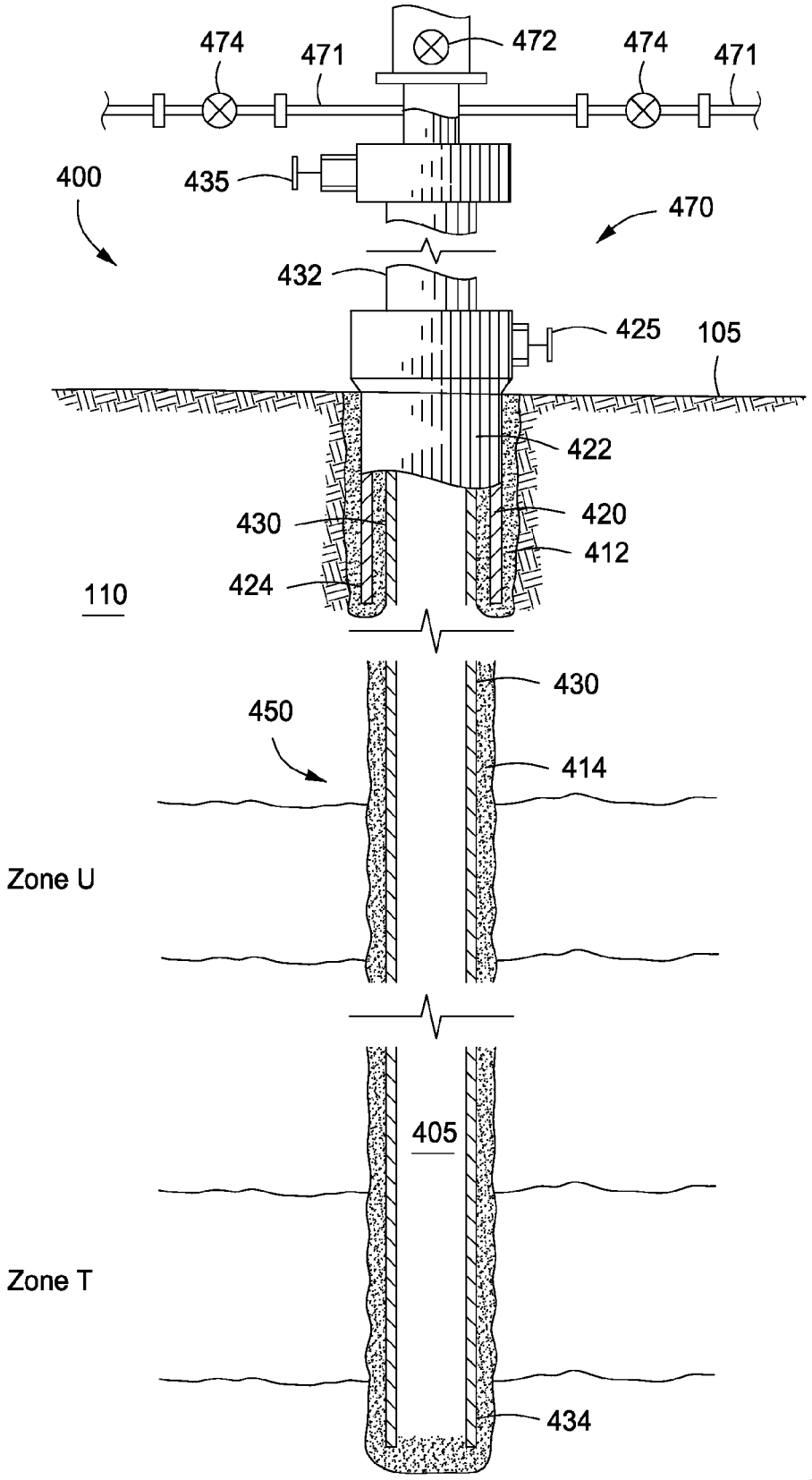
FIGS. 4A through 4N present side views of a well site. A lower portion of a wellbore is shown. The wellbore is receiving various autonomous tool assemblies for completing a well.

A device not described in the application is a fluid container. FIGS. 4A through 4N demonstrate selected steps for completing a well, including the use of a fluid container, or canister, for delivering fluid to a selected subsurface formation. The fluid container is part of a fluid delivery assembly 410, shown specifically in FIGS. 4F1, 4F2, 4M1, 4M2, and 4M3.

FIGS. 4A through 4M demonstrate the use of various autonomous tools in an illustrative wellbore. First, FIG. 4A presents a side view of a well site 400. The well site 400 includes a wellhead 470 and a wellbore 450. The wellbore 450 includes a bore 405 for receiving the autonomous tool assemblies and other completion equipment. The bore 405 extends from the surface 105 of the earth, and into the earth's subsurface 110. The wellbore 450 is being completed in at least zones of interest "T" and "U" within the subsurface 110.

The wellbore 450 is first formed with a string of surface casing 420. The surface casing 420 has an upper end 422 in sealed connection with a lower master fracture valve 425. The surface casing 420 also has a lower end 424. The surface casing 420 is secured in the wellbore 450 with a surrounding cement sheath 412.

The wellbore 450 also includes a string of production casing 430. The production casing 430 is also secured in the wellbore 450 with a surrounding cement sheath 414. The production casing 430 has an upper end 432 in sealed connection with an upper master fracture valve 435. The production casing 430 also has a lower end 434 proximate a bottom of the wellbore 450. It is understood that the bottom or depth of the wellbore 450 extends many thousands of feet below the earth surface 105.

The production casing 430 extends through the lowest zone of interest "T," and also through at least one zone of interest "U" above the zone "T." A wellbore operation will be conducted that includes perforating each of zones "T" and "U" sequentially.

During the completion phase, the wellhead 470 will also include one or more blow-out preventers. The blow-out preventers are typically remotely actuated in the event of operational upsets. In more shallow wells, or in wells having lower formation pressures, the master fracture valves 425, 435 may be the blow-out preventers. In either event, the master fracture valves 425, 435 are used to selectively seal the wellbore 450.

The wellhead 470 and its components are used for flow control and hydraulic isolation during rig-up operations, stimulation operations, and rig-down operations. The wellhead 470 may include a crown valve 472. The crown valve 472 is used to isolate the wellbore 400 when downhole tools are placed above the wellhead 470 before being launched into the wellbore 450. The wellhead 470 further includes side outlet injection valves 474. The side outlet injection valves 474 are located within fluid injection lines 471. The fluid injection lines 471 provide a means for the injection of fracturing fluids, weighting fluids, and/or stimulation fluids into the bore 405, with the injection of the fluids being controlled by the valves 474.

The piping from surface pumps (not shown) and tanks (not shown) used for injection of the stimulation (or other) fluids are attached to the valves 474. Appropriate hoses, fittings and/or couplings (not shown) are employed. The stimulation fluids are then pumped into the production casing 430.

It is understood that the various wellhead components shown in FIG. 4A are merely illustrative. A typical completion operation will include numerous valves, pipes, tanks, fittings, couplings, gauges, and other fluid control devices. These may include a pressure-equalization line and a pressure-equalization valve (not shown) for positioning a tool string above the lower valve 425 before the tool string is dropped into the wellbore 405. Downhole equipment may be run into and out of the wellbore 450 using an electric line, slick line or coiled tubing. Further, a drilling rig or other platform may be employed, with jointed working tubes being used.

Figure 4B:
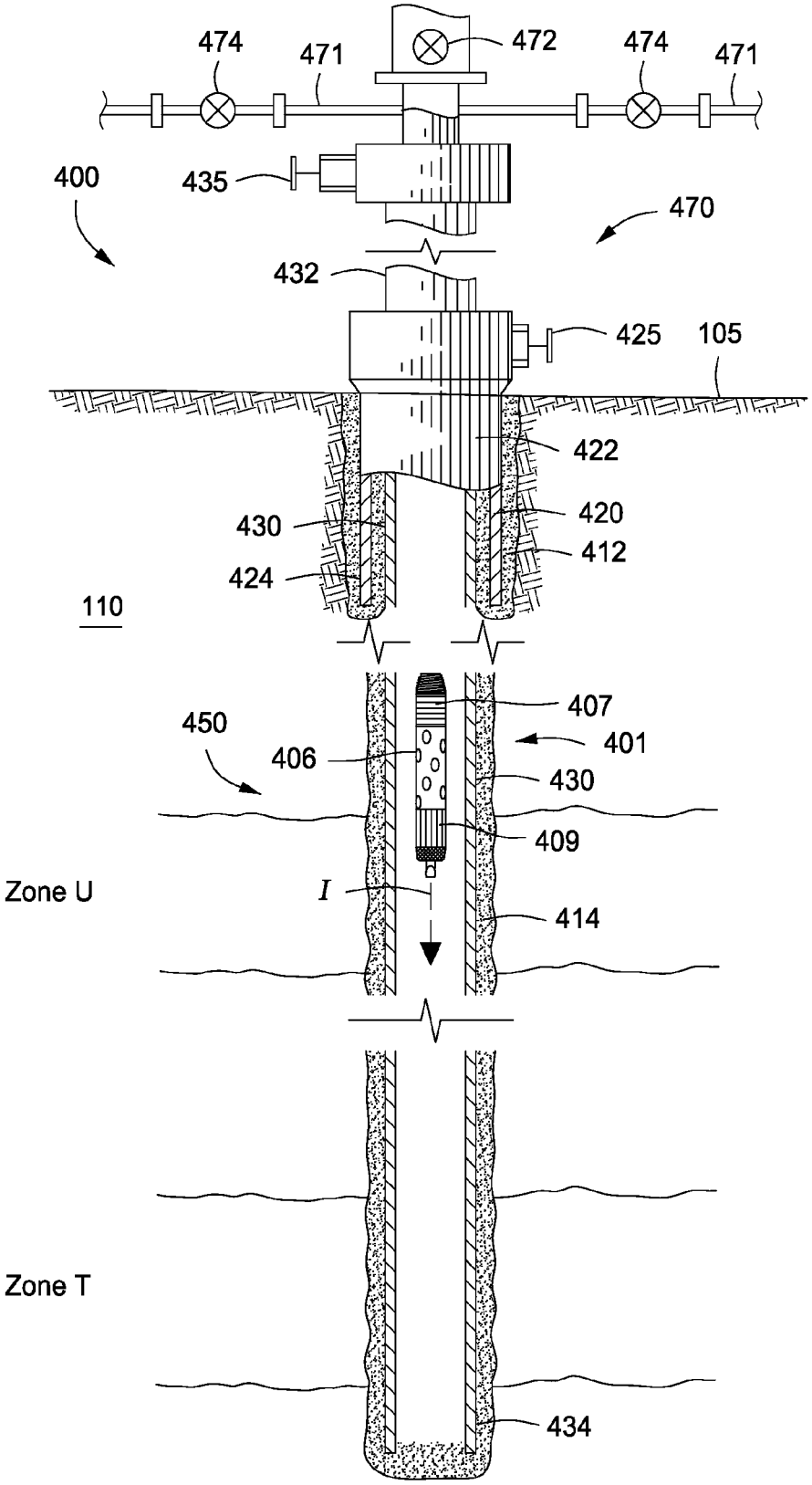
FIG. 4B is a side view of the well site of FIG. 4A. Here, the wellbore has received a first perforating gun assembly, in one embodiment.

FIG. 4B is another side view of the well site 400 of FIG. 4A. Here, the wellbore 450 has received a first perforating gun assembly 401. The first perforating gun assembly 401 is designed to operate in an autonomous fashion, as described more fully in U.S. Provisional Pat. Appl. No. 61/348,578, referenced and incorporated above.

The perforating gun assembly 401 includes a perforating gun 406. The perforating gun 406 may be a select fire gun that fires, for example, 16 shots. The gun 406 has associated charges that detonate in order to cause shots to be fired from the gun 406 into the surrounding production casing 430. Typically, the perforating gun 406 contains a string of shaped charges distributed along the length of the gun 406 and oriented according to desired specifications. The charges are preferably connected to a single detonating cord to ensure simultaneous detonation of all charges. Examples of suitable perforating guns include the Frac Gun™ from Schlumberger, and the G-Force® from Halliburton.

It can be seen in FIG. 4B that the perforating gun assembly 401 is moving downwardly in the wellbore 450, as indicated by arrow "I." The perforating gun assembly 401 may simply be falling through the wellbore 450 in response to gravitational pull. In addition, the operator may be assisting the downward movement of the perforating gun assembly 401 by applying hydraulic pressure through the use of surface pumps (not shown). Alternatively, the perforating gun assembly 401 may be aided in its downward movement through the use of a tractor (not shown).

Figure 4C:
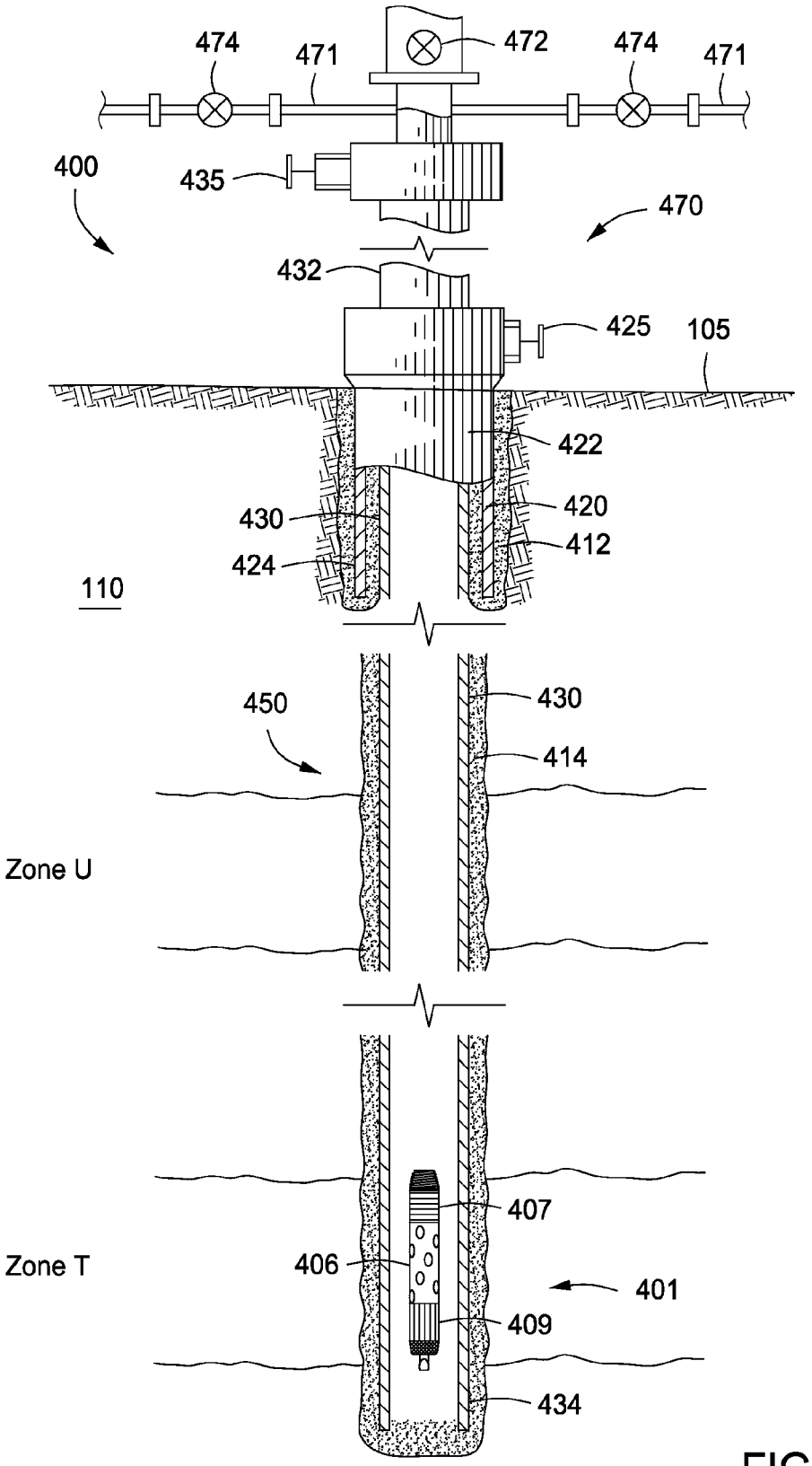
FIG. 4C is another side view of the well site of FIG. 4A. Here, the first perforating gun assembly has fallen in the wellbore to a position adjacent zone of interest "T."

FIG. 4C is still another side view of the well site 400 of FIG. 4A. Here, the first perforating gun assembly 401 has fallen in the wellbore 450 to a position adjacent zone of interest "T." In accordance with the present inventions, the perforating gun assembly 401 includes a locator device 407. The locator device 407 operates in accordance with locator device 214 described in connection with FIG. 2. In this respect, the locator device 407 generates signals in response to tags or "downhole markers" placed along the production casing 430.

The perforating gun assembly 401 also includes an on-board controller 409. The on-board controller 409 operates in accordance with on-board controller 216 of FIG. 2. In this respect, the on-board controller 409 processes the depth signals generated by the position locator 407 using appropriate logic and power units. In one aspect, the on-board controller 409 compares the generated signals with a predetermined physical signature obtained for the wellbore objects (such as collars 254 of FIG. 2).

Figure 4D:
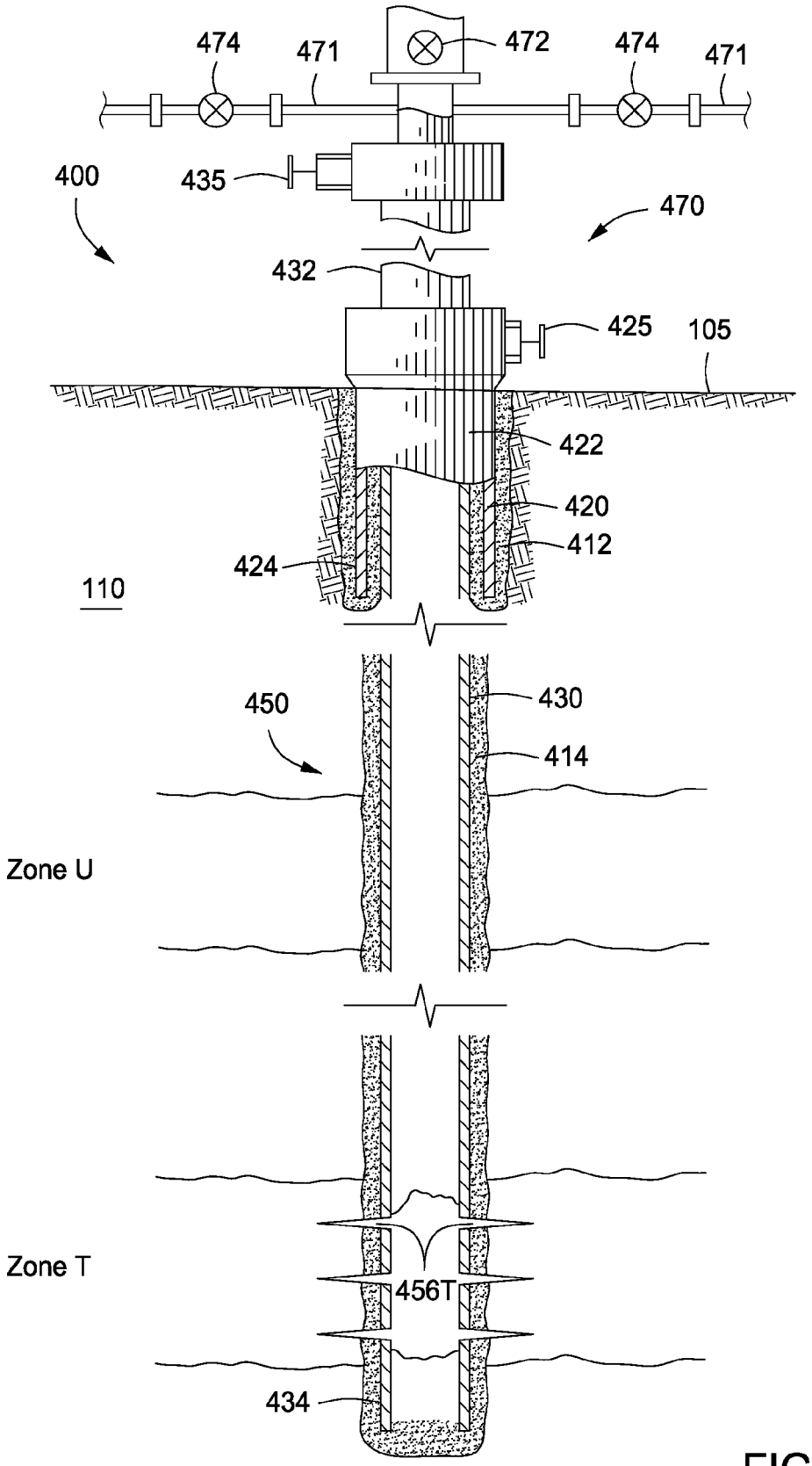
FIG. 4D is another side view of the well site of FIG. 4A. Here, charges of the first perforating gun assembly have been detonated, causing a perforating gun of the perforating gun assembly to fire. The casing along the zone of interest "T" has been perforated.

FIG. 4D is another side view of the well site 400 of FIG. 4A. Here, charges of the perforating gun assembly 401 have been detonated, causing the perforating gun 406 to fire. The casing along zone of interest "T" has been perforated. A set of perforations 456T is shown extending from the wellbore 450 and into the subsurface 110. While only six perforations 456T are shown in the side view, it us understood that additional perforations may be formed, and that such perforations will extend radially around the production casing 430.

In addition to the creation of perforations 456T, the perforating gun assembly 401 is self-destructed. The on-board controller 409 activates a detonating cord that ignites the charge associated with the perforating gun 406 to initiate the perforation of the production casing 430 at a desired depth or location. To accomplish this, the components of the gun assembly 401 are fabricated from a friable material. The perforating gun 401 may be fabricated, for example, from ceramic materials. Upon detonation, the material making up the perforating gun assembly 401 may become part of the proppant mixture injected into fractures in a later completion stage.

Figure 4E:
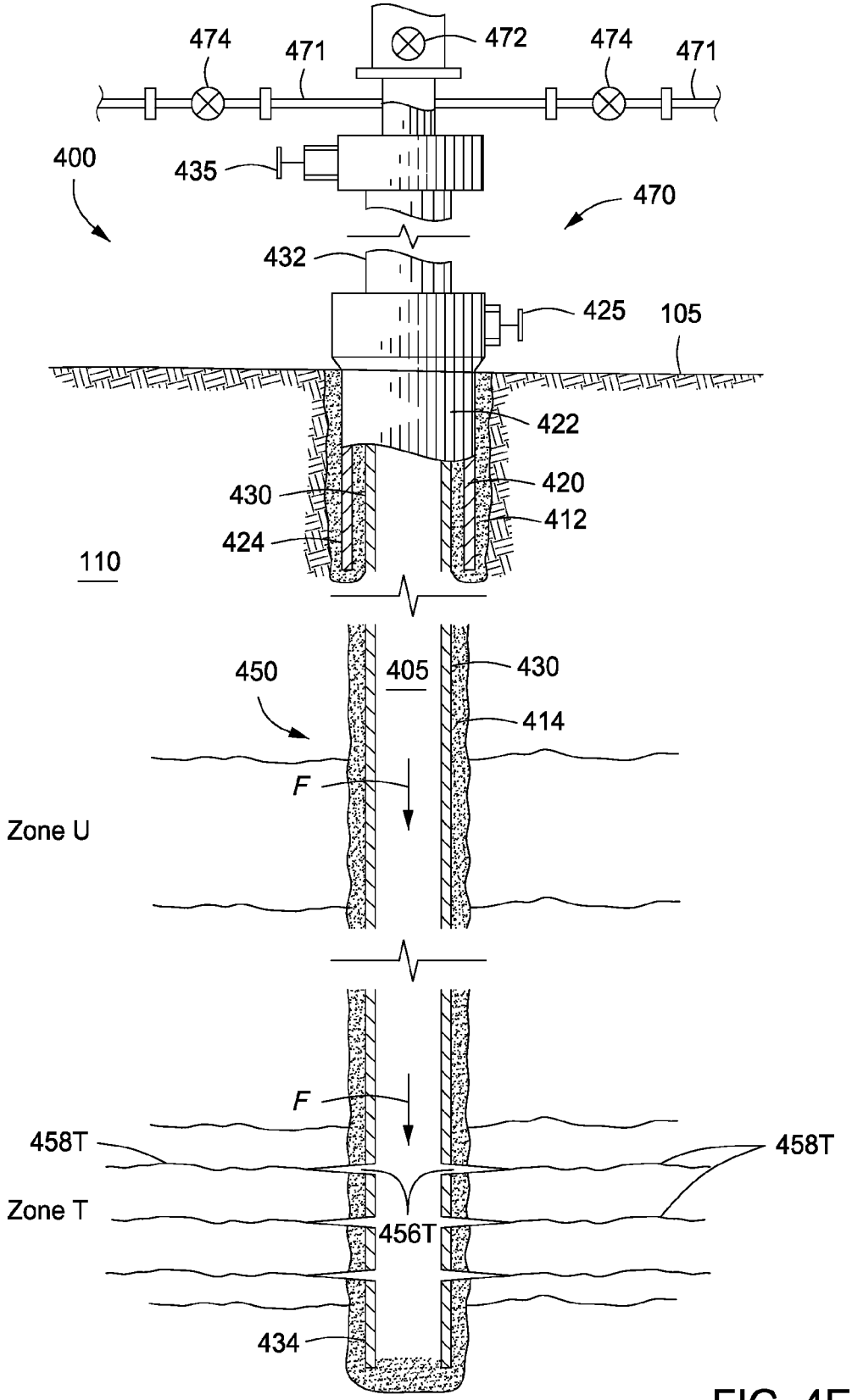
FIG. 4E is yet another side view of the well site of FIG. 4A. Here, fluid is being injected into the wellbore under high pressure, causing the formation within the zone of interest "T" to be fractured.

FIG. 4E is yet another side view of the well site 400 of FIG. 4A. Here, fluid is being injected into the bore 405 of the wellbore 450 under high pressure. Downward movement of the fluid is indicated by arrows "F." The fluid moves through the perforations 456T and into the surrounding subsurface 110. This causes fractures 458T to be formed within the zone of interest "T."

It is desirable to place an acid solution into the bore 405 proximate the new perforations 456T so as to remove carbonate build-up and remaining drilling mud. The acid solution may further be injected into the newly-formed fractures 458T to stimulate the subsurface 110 for hydrocarbon production. Historically, this has been done simply by injecting a volume of acid solution, or "spotting" the acid solution, into the wellbore, and pumping it down. However, it is desirable to more precisely spot the desired volume of acid. This may be done through the use of a novel fluid delivery assembly.

FIGS. 4F1 and 4F2 provide additional side views of the well site 400 of FIG. 4A. Here, the wellbore 450 has received a fluid delivery assembly 410. The fluid delivery assembly 410 includes a fluid container 415. Preferably, the fluid container 415 is an elongated, cylindrical container for holding a designated volume of fluid.

The fluid delivery assembly 410 represents yet another autonomous tool. In accordance with the present inventions, the fluid delivery assembly 410 includes a locator device 414. The locator device 4147 operates in accordance with locator device 214 described in connection with FIG. 2. In this respect, the locator device 414 generates signals in response to tags or "downhole markers" placed along the production casing 430.

The fluid delivery assembly 410 also includes an on-board controller 416. The on-board controller 416 operates in accordance with on-board controller 216 of FIG. 2. In this respect, the on-board controller 416 processes the depth signals generated by the position locator 414 using appropriate logic and power units. In one aspect, the on-board controller 416 compares the generated signals with a predetermined physical signature obtained for the wellbore objects, such as casing collars. For example, a CCL log may be run before deploying the autonomous tool in order to determine the spacing of the casing collars. The corresponding depths of the casing collars may be determined based on the speed of the wireline that pulled the CCL logging device.

It is preferred that the position locator 414 and the on-board controller 416 operate with software in accordance with the locating algorithm discussed above. Specifically, the algorithm preferably employs a windowed statistical analysis for interpreting and converting magnetic signals generated by the casing collar locator.

The fluid delivery assembly 410 also includes one or more actuatable tools. In the arrangement of FIGS. 4F1 and 4F2, a set of slips 417 is provided as an actuatable tool. The slips 417 are set in response to action of a setting tool 412. Setting tool 412 may be in accordance with setting tool 212 described above in connection with FIG. 2. The slips 417 are set in response to an activation signal sent from the on-board controller 416 when the on-board controller 416 determines that the fluid delivery assembly 410 as reached a specified location in the wellbore 450. Thus, the setting tool 412 may be considered part of the actuatable tool.

The actuatable tool also includes a valve 411. The valve 411 is shown as a plurality of flow ports. In the view of FIG. 4F1, the flow ports of the valve 411 are darkened, indicating that they are closed. In the view of FIG. 4F2, the flow ports of the valve 411 are lightened, indicating that they are open.

In FIG. 4F1, the fluid delivery assembly 410 is in its run-in (pre-actuated) position. The slips, indicated at 417', have not been set. In FIG. 4F2, the fluid delivery assembly 410 is in its set (actuated) position. The slips, indicated at 417", have engaged the surrounding casing 430. This is in response to an actuation signal having been sent from the on-board controller 414 to the setting tool 412 to actuate the slips 417".

It is noted that the use of slips 417 is optional. In one embodiment, the fluid delivery assembly 410 is designed to open the valve 411 when the fluid container 415 reaches the desired subsurface location without the fluid delivery assembly 410 being set. This embodiment is particularly applicable hen the fluid delivery assembly 410 is going all the way to the bottom of the wellbore.

In one embodiment, the fluid delivery assembly 410 is fabricated from a friable material, such as ceramic. In this instance, the fluid delivery assembly 410 may be designed to self-destruct in response to a designated event such as a period of time after the slips 417 have set or the valve 411 is opened. Optionally, the fluid delivery assembly includes a detonator for providing the self-destruction. In this instance, destruction of the fluid delivery assembly causes the fluid container to no longer hold fluid, thereby releasing the fluid. In this way, the detonator may actually be the actuatable tool, and no slips or valves are needed. Alternatively, the detonator ignites charges that cause the fluid delivery assembly 410 to self-destruct a set time after the fluid has been released from the fluid container 415.

Figure 4G:
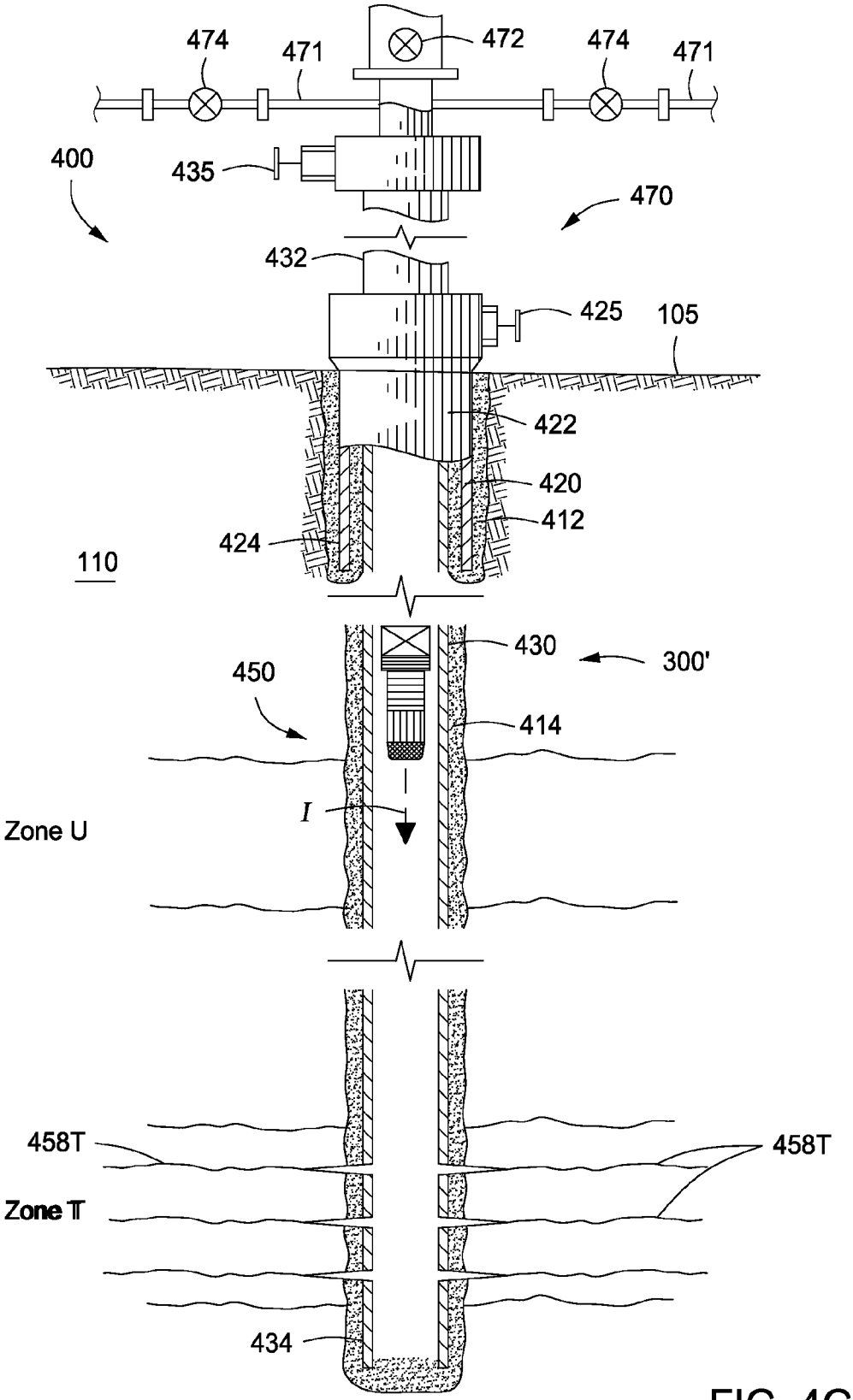
FIG. 4G is another side view of the well site of FIG. 4A. Here, a fracturing plug assembly has been released into the wellbore.

FIG. 4G provides yet another side view of the well site 400 of FIG. 4A. Here, a new fracturing plug assembly 300' has been released into the wellbore 450. The fracturing plug assembly 300' is falling into the wellbore 450 in response to gravity. Optionally, the fracturing plug assembly 300' is also being pumped down the wellbore 450.

In accordance with the present inventions, the locator device (shown at 314 in FIG. 3) has generated signals in response to downhole markers placed along the production casing 430. In this way, the on-board controller (shown at 316 of FIG. 3) is aware of the location of the fracturing plug assembly 300".

Figure 4H:
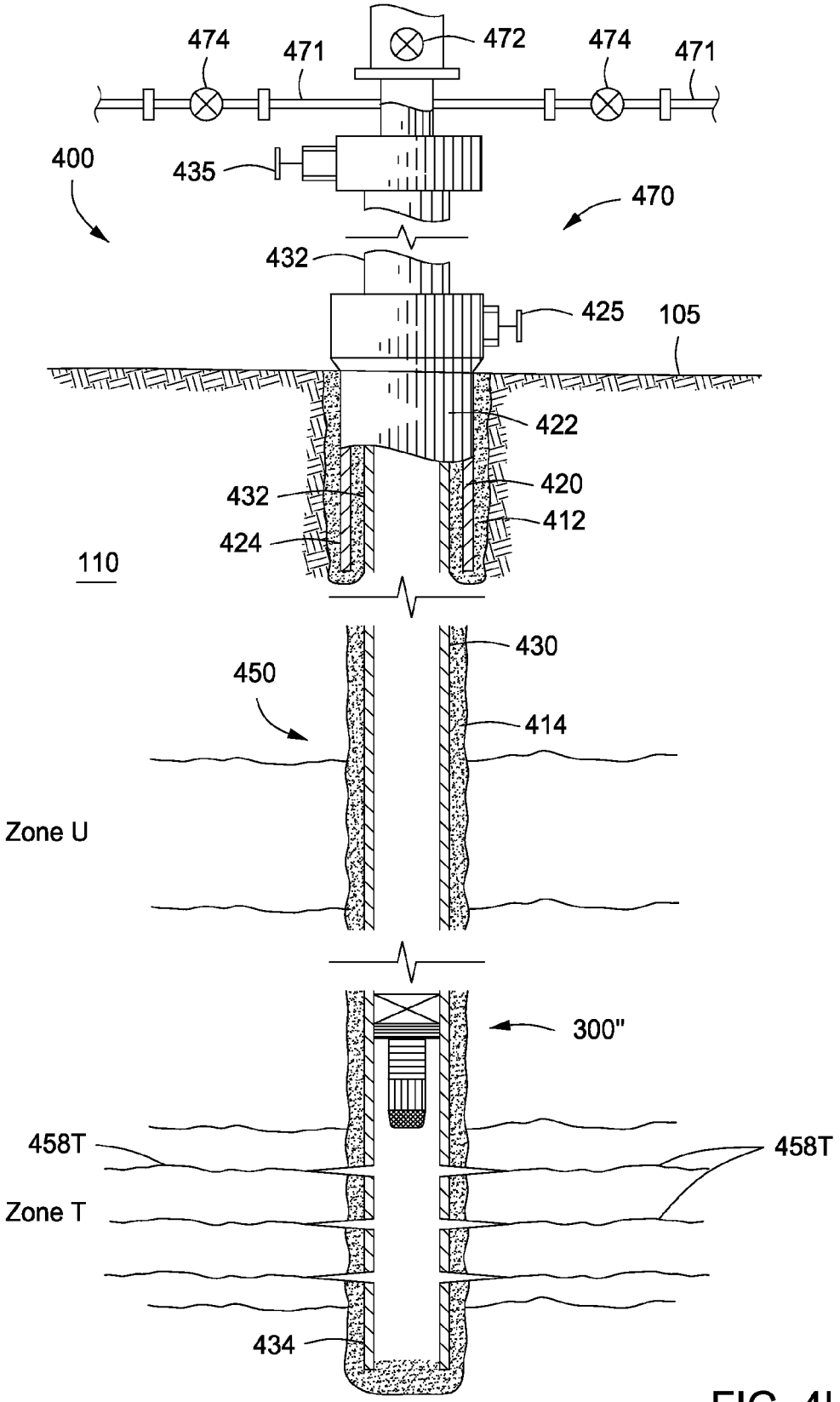
FIG. 4H is another side view of the well site of FIG. 4G. Here, the fracturing plug assembly has been actuated and set. The fracturing plug assembly is set below zone of interest "U." Of interest, no wireline is needed for setting the plug assembly.

FIG. 4H is another side view of the well site 400 of FIG. 4A. Here, the fracturing plug assembly 300" has been set. This means that the on-board controller 316 has generated signals to activate the setting tool (shown at 312 of FIG. 3), the plug (shown at 310" of FIG. 3) and the slips (shown at 113') to set and to seal the plug assembly 300" in the bore 405 of the wellbore 450. In FIG. 4H, the fracturing plug assembly 300" has been set above the zone of interest "T." This allows isolation of the zone of interest "U" for a next perforating stage.

Figure 4I:
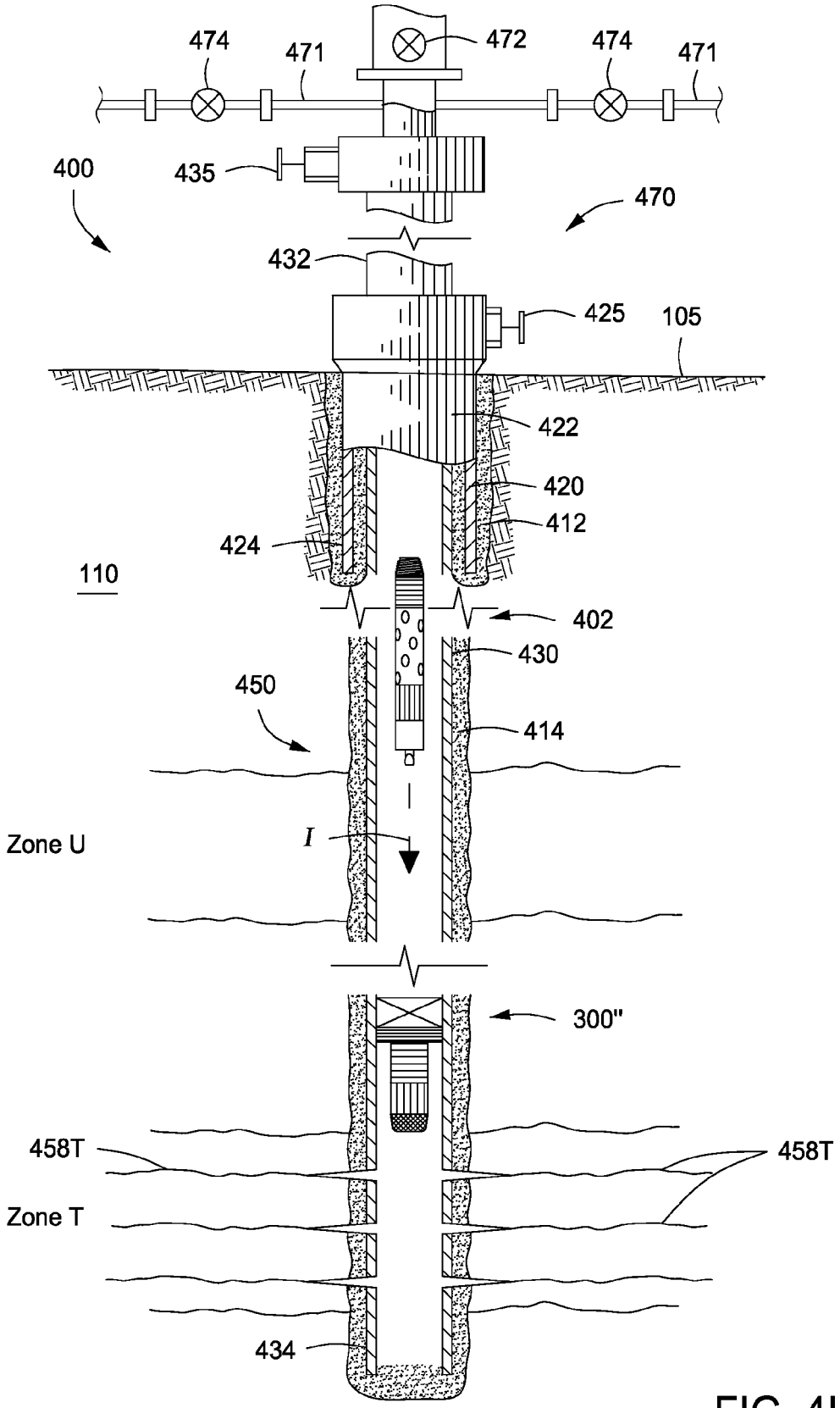

FIG. 4I is another side view of the well site 400 of FIG. 4A. Here, the wellbore 450 has received a second perforating gun assembly 402. The second perforating gun assembly 402 may be constructed and arranged as the first perforating gun assembly 401. This means that the second perforating gun assembly 402 is also autonomous.

It can be seen in FIG. 4I that the second perforating gun assembly 402 is moving downwardly in the wellbore 450, as indicated by arrow "I." The second perforating gun assembly 402 may be simply falling through the wellbore 450 in response to gravitational pull. In addition, the operator may be assisting the downward movement of the perforating gun assembly 402 by applying hydraulic pressure through the use of surface pumps (not shown). Alternatively, the perforating gun assembly 402 may be aided in its downward movement through the use of a tractor (not shown).

It can also be seen in FIG. 4I that the fracturing plug assembly 300" remains set in the wellbore 450. The fracturing plug assembly 300" is positioned above the perforations 456T and the fractures 458T in the zone of interest "T." Thus, the perforations 456T are isolated.

Figure 4J:
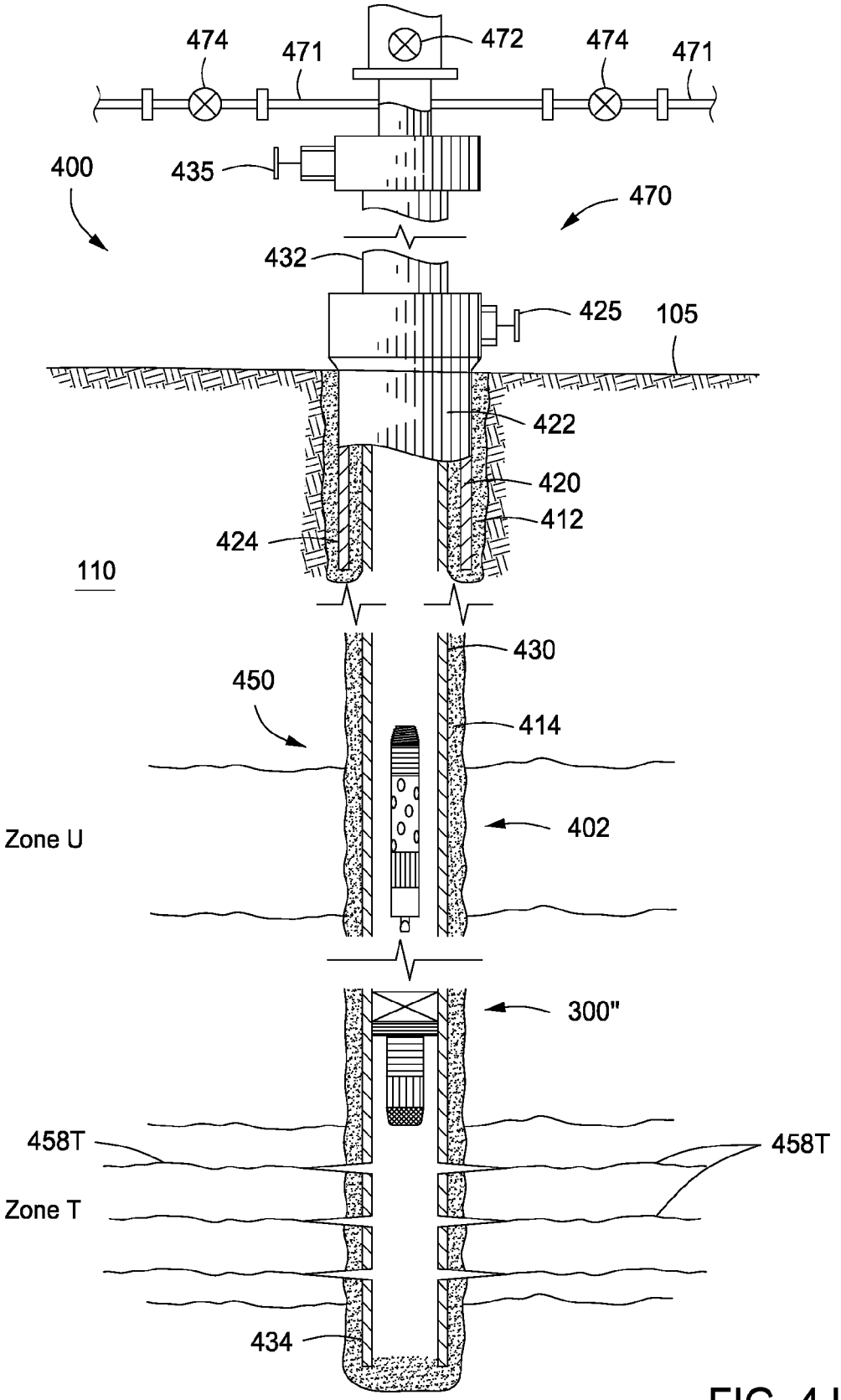
FIG. 4J is a side view of the well site of FIG. 4I. Here, the second perforating gun assembly has fallen in the wellbore to a position adjacent zone of interest "U." Zone of interest "U" is above zone of interest "T."

FIG. 4J is another side view of the well site 400 of FIG. 4A. Here, the second perforating gun assembly 402 has fallen in the bore 405 to a position adjacent zone of interest "U." Zone of interest "U" is above zone of interest "T." In accordance with the present inventions, the locator device has generated signals in response to downhole markers placed along the production casing 430. In this way, the on-board controller is aware of the location of the second perforating gun assembly 402.

Figure 4K:
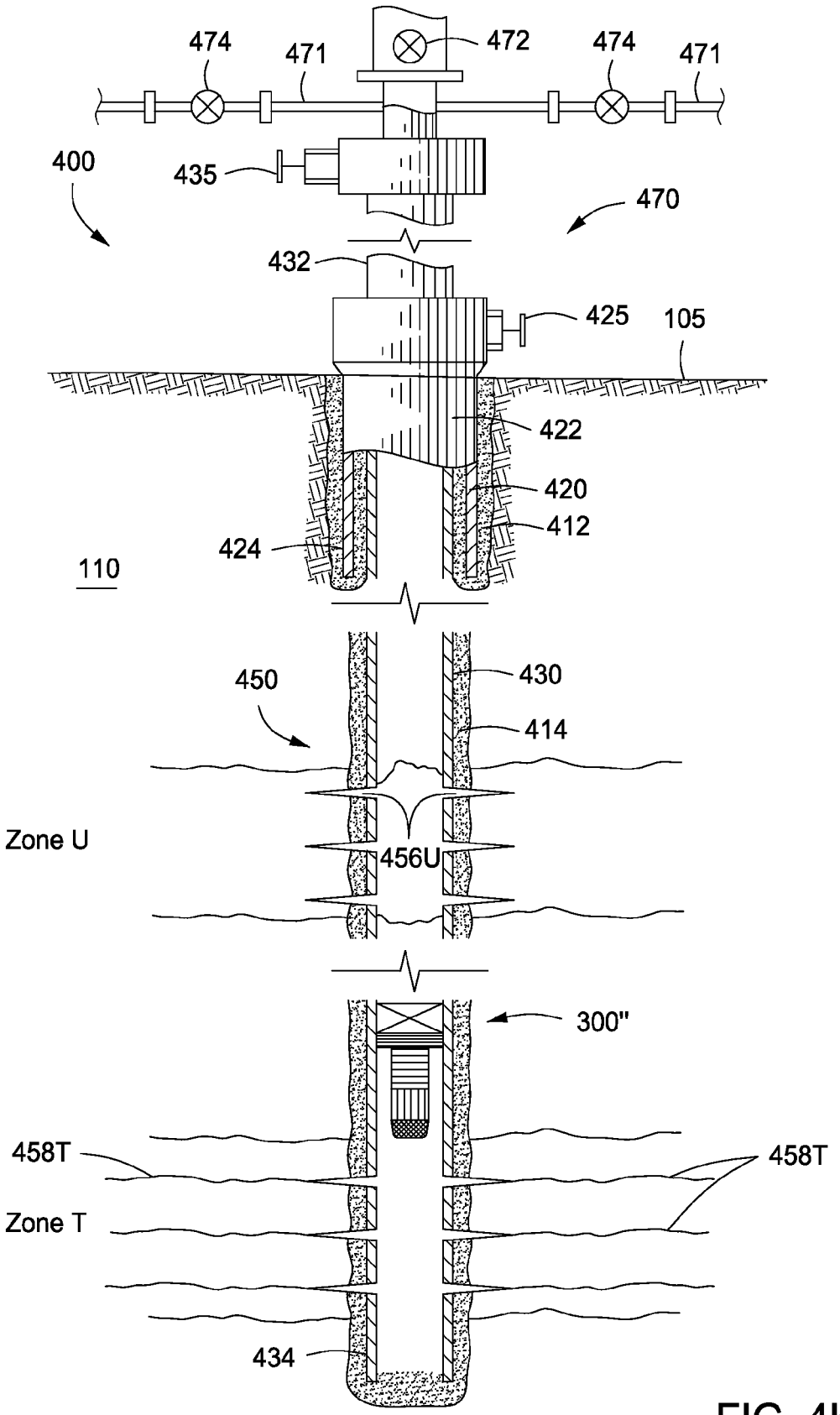
FIG. 4K is another side view of the well site of FIG. 4I. Here, charges of the second perforating gun assembly have been detonated, causing the perforating gun of the perforating gun assembly to fire. The casing along the zone of interest "U" has been perforated.

FIG. 4K is subsequent side view of the well site 400 of FIG. 4A. Here, charges of the second perforating gun assembly 402 have been detonated, causing the perforating gun of the perforating gun assembly 402 to fire. The zone of interest "U" has been perforated. A set of perforations 456U is shown extending from the wellbore 450 and into the subsurface 110. While only six perforations 456U are shown in side view, it us understood that additional perforations are formed, and that such perforations may extend radially around the production casing 430.

In addition to the creation of perforations 456U, the second perforating gun assembly 402 is self-destructed. Any pieces left from the assembly 402 will likely fall to the plug assembly 300" still set in the production casing 430.

It is understood that the order of deploying the fracturing plug assembly 300' of (seen in FIG. 4G) and deploying the second perforating gun assembly 402 (seen in FIG. 4I) may be reversed. In this way, the fracturing plug assembly 300" (seen in FIG. 4I) is not set until after the perforations 456U (seen in FIG. 4K) are formed.

Figure 4L:
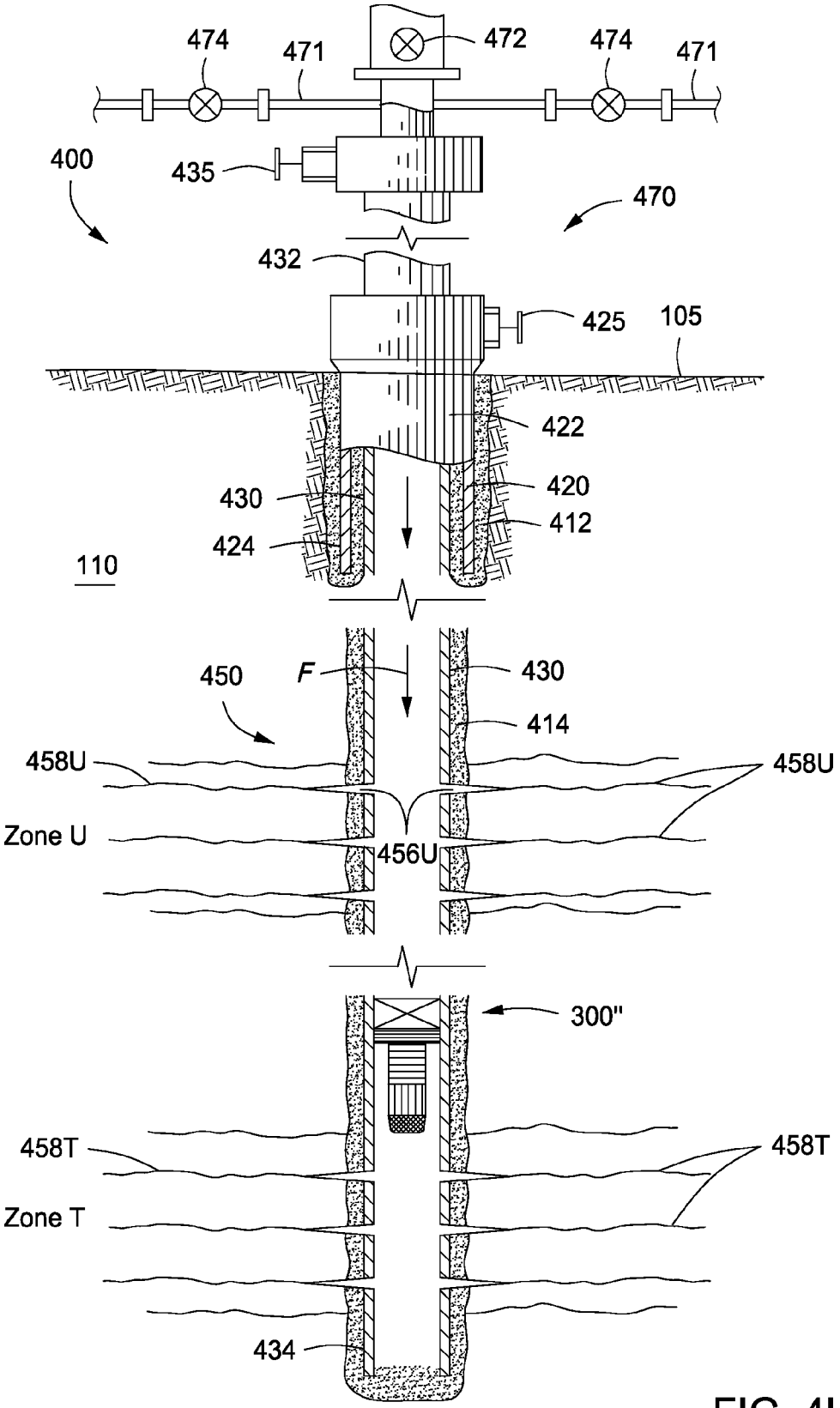
FIG. 4L is still another side view of the well site of FIG. 4A. Here, fluid is being injected into the wellbore under high pressure, causing the formation within the zone of interest "U" to be fractured.
Figure 4N:
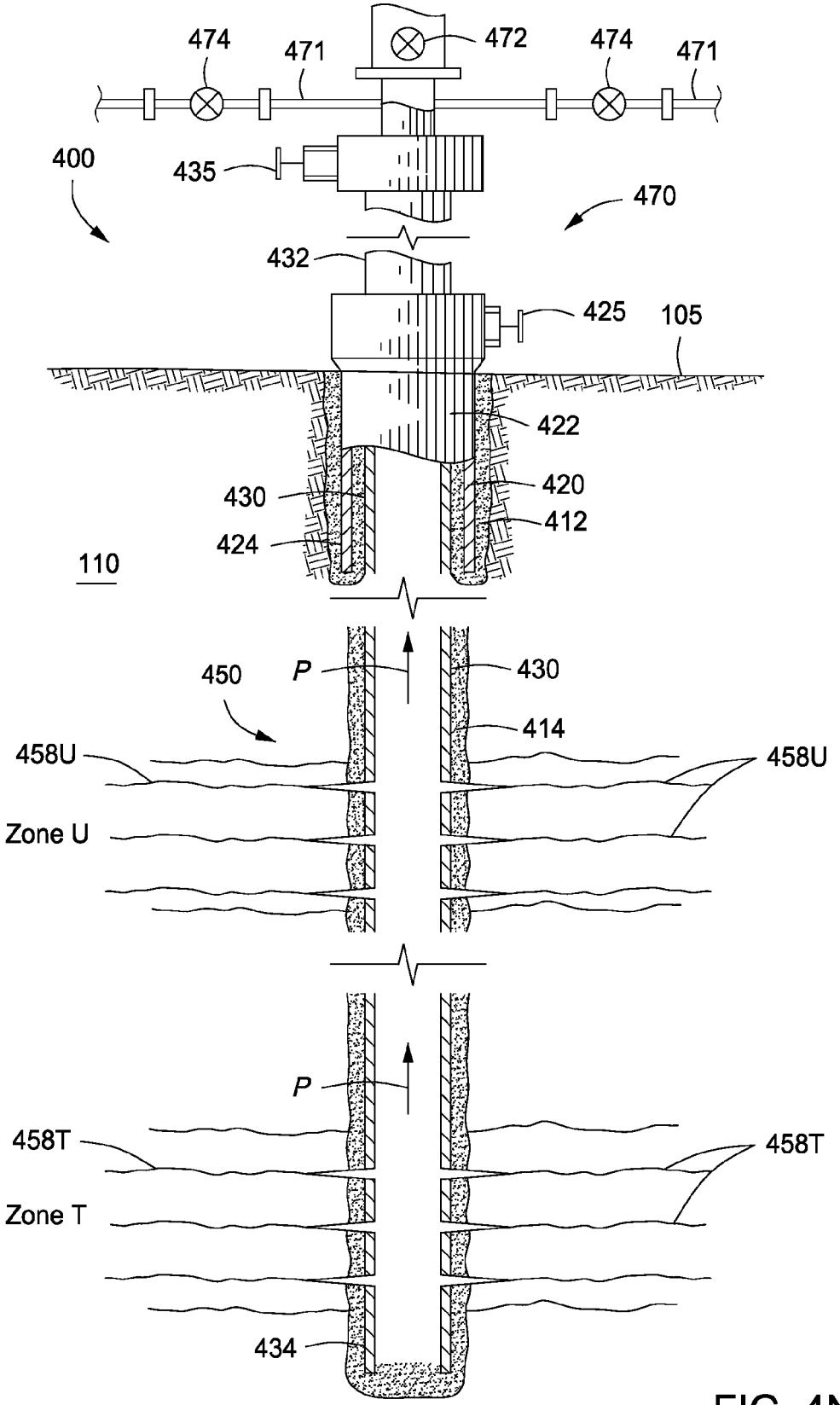

FIG. 4L is yet another side view of the well site 400 of FIG. 4A. Here, fluid is being injected into the bore 405 of the wellbore 450 under high pressure. The fluid injection causes the subsurface 110 within the zone of interest "U" to be fractured. Downward movement of the fluid is indicated by arrows "F." The fluid moves through the perforations 456U and into the surrounding subsurface 110. This causes fractures 458U to be formed within the zone of interest "U." An acid solution may also optionally be circulated into the bore 405 to remove carbonate build-up and remaining drilling mud and further stimulate the subsurface 110 for hydrocarbon production.

FIGS. 4M1, 4M2 and 4M3 provide additional side views of the well site 400 of FIG. 4A. In FIG. 4M1, a second fluid conveyance assembly 410 has been placed downhole. The fluid conveyance assembly 410 is shown in a pre-actuated position, and has reached the level of the zone of interest "U."

Here, the fluid conveyance assembly 410 is tethered to the surface by means of a slickline. A slickline is shown at 485. The slickline 485 is provided for the purpose of enabling the operator to retrieve the fluid conveyance assembly 410 after fluid has been delivered to the zone of interest "U." This is in lieu of using a detonator.

As an alternative to using a slickline 485, a tool assembly may be run into the wellbore with a tractor (not shown). This is particularly advantageous in deviated wellbores.

FIG. 4M2 is a subsequent side view of the well site 400 of FIG. 4M1. Here, the flow ports in a fluid container 415 of the fluid delivery assembly 410 have been opened. This is the actuated position for the fluid delivery assembly 410. The flow ports have been opened, thereby releasing fluid into the wellbore adjacent the zone of interest "U."

In this process, the treatment fluid is an acid or a surfactant used for cleaning up drilling mud along the perforations 456U and the fracture tunnels 458U. Alternatively, the fluid may be air. Opening the fluid container 415 in this instance will create an area of negative pressure that pulls wellbore fluids and drilling mud into the chamber. This, in turn, has an instant cleaning effect for the perforations 456U and fracture tunnels 458U.

FIG. 4M3 is still a subsequent side view of the well site 400 of FIG. 4M1. Here, the fluid delivery assembly 410 is being raised back to the surface 105. The wireline 85 is being spooled back to the surface 105.

Finally, FIG. 4N provides a side view of the well site 400 of FIG. 4A after well completion. Here, the fluid delivery assembly 410 has been removed from the wellbore. In addition, the wellbore 450 is now receiving production fluids. Arrows "P" indicate the flow of production fluids from the subsurface 110 into the wellbore 450 and towards the surface 105.

FIGS. 4A through 4N demonstrate the use of various autonomous tools to fracture and treat a formation. Two separate zones of interest (zones "T" and "U") have been treated within an illustrative wellbore 450. In this example, both the first 401 and the second 402 perforating gun assemblies were autonomous, and the fracturing plug assembly 300 was also autonomous. Further, the fluid delivery assembly 410 was autonomous. However, it is possible to perforate the lowest zone "T" using a traditional wireline with a select-fire gun assembly, but then use autonomous perforating gun assemblies to perforate multiple zones above the terminal zone "T."

It is also possible to deploy the above tools as autonomous tools, that is, tools that are not electrically actuated from the surface, using a slickline. The use of a slickline is shown in FIGS. 4M1, 4M2, and 4M3 described above. The fluid delivery assembly may include a fishing neck (not shown) which is dimensioned and configured to serve as the male portion to a mating downhole fishing tool (not shown). The fishing neck 210 allows the operator to retrieve the fluid delivery assembly in the unlikely event that it becomes stuck in the casing.

It is desirable with autonomous tools, including particularly the perforating gun assemblies 401, 402, to provide various safety features that prevent the premature actuation or firing of the tool. These are in addition to the locator device and on-board controller described above. Preferably, each autonomous tool utilizes at least two, and preferably at least three, safety gates or "barriers" that must be satisfied before the perforating gun may be "armed" or a tool is detonated or fluid is released or slips or set, depending on the arrangement and function of the tool.

A safety system is described below in connection with a perforating gun assembly. However, it is understood that the safety system has equal application to other autonomous tools.

First, one safety check that may be used is a vertical position indicator. This means that the on-board controller will not provide a signal to the select gun to fire until the vertical position indicator confirms that the perforating gun assembly is oriented in a substantially vertical orientation, e.g., within five degrees of vertical. For example, the vertical position indicator may be a mercury tube that is in electrical communication with the on-board controller. Of course, this safety feature only works where the wellbore is being perforated or the tool is being actuated along a substantially vertical zone of interest.

Another safety check may be a pressure sensor or a rupture disc in electrical communication with the on-board controller. Those of ordinary skill in the art will understand that as the assembly moves down the wellbore, it will experience an increased hydrostatic head. Pressure from the hydrostatic head may be enhanced by using pumps at the surface (not shown) for pumping the perforating gun assembly downhole. Thus, for example, the pressure sensor may not send (or permit) a signal from the on-board controller to the perforating gun until pressure exceeds, for example, 4,000 psi.

A third safety check that may be utilized involves a velocity calculation. In this instance, the perforating gun assembly may include a second locator device spaced some distance below the original locator device. As the assembly travels across casing collars, signals generated by the second and the original locator devices are timed. The velocity of the assembly is determined by the following equation:

$$D/(T_2-T_0)$$

Where: $T_0$=Time stamp of the detected signal from the original locator device;

$T_2$=Time stamp of the detected signal from a second locator device; and

D=Distance between the original and second locator devices.

Use of such a velocity calculation ensures both a depth and the present movement of the perforating gun assembly before the firing sequence can be initiated.

Still a fourth safety check that may be utilized involves a timer. In this arrangement, the perforating gun assembly may include a button or other user interface that allows an operator to manually "arm" the perforating gun. The user interface is in electrical communication with a timer within the on-board controller. For example, the timer might be 2 minutes. This means that the perforating gun cannot fire for 2 minutes from the time of arming. Here, the operator must remember to manually arm the perforating gun before releasing the perforating gun into the wellbore.

Yet a fifth safety check that may be employed involves the use of low-life batteries. For example, the perforating gun assembly may be powered with a battery pack, but the batteries are not installed until shortly before the assembly is dropped into a wellbore. This helps to ensure safety during transportation of the tool. In addition, the batteries may have an effective life of, for example, only 60 minutes. This ensures that the assembly's energy potential is lost at a predictable time in the event that the assembly needs to be pulled.

Figure 5:
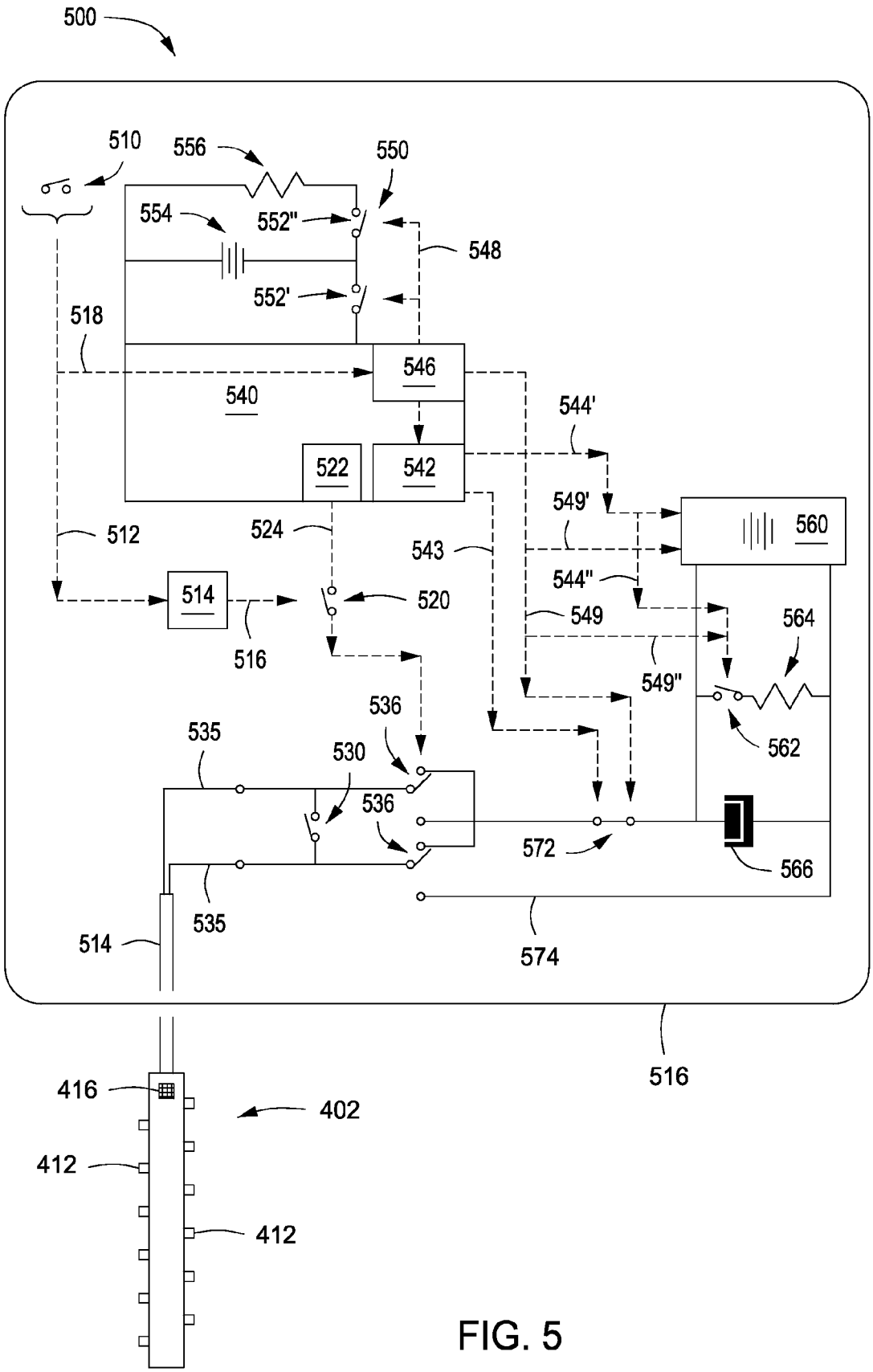
FIG. 5 schematically illustrates a multi-gated safety system for an autonomous wellbore tool, in one embodiment.

The on-board controller and the safety checks for the autonomous tool are part of a safety system. Additional details concerning a safety system are shown in FIG. 5. FIG. 5 schematically illustrates a multi-gated safety system 500 for an autonomous wellbore tool, in one embodiment. In the safety system 500 of FIG. 5, five separate gates are provided. The gates are indicated at 510, 520, 530, 540, and 550. Each of these illustrative gates 510, 520, 530, 540, 550 represents a condition that must be satisfied in order for detonation charges to be delivered to a perforating gun. Stated another way, the gated safety system 500 keeps the detonators inactive while the perforating gun assembly is at the surface or is in transit to a well site.

Using the gates 510, 520, 530, 540, 550, electrical current to the detonators 416 is initially shunted to prevent detonation caused by stray currents. In this respect, electrically actuated explosive devices can be susceptible to detonation by stray electrical signals. These may include radio signals, static electricity, or lightening strikes. After the assembly is launched, the gates are removed. This is done by unshunting the detonator by operating an electrical switch, and by further closing electrical switches one by one until an activation signal may pass through the safety circuit and the detonators 416 are active.

In FIG. 5, a perforating gun is seen at 402. This is representative of the gun shown at 402 in FIG. 41. The perforating gun 402 includes a plurality of shaped charges 412. The charges are distributed along the length of the gun 402. The charges 412 are ignited in response to an electrical signal delivered from the controller 516 through electrical lines 535 and to the detonators 416. The lines 535 are bundled into a sheath 514 for delivery to the perforating gun 412 and the detonators 416. Optionally, the lines 535 are pulled from inside the tool assembly 402 as a safety precaution until the tool assembly 402 is delivered to a well site.

The detonators 416 receive an electrical current from a firing capacitor 566. The detonators 416 then deliver heat to the charges 412 to create the perforations. Electrical current to the detonators 416 is initially shunted to prevent detonation from stray currents. In this respect, electrically actuated explosive devices can be susceptible to detonation by stray electrical signals. These may include radio signals, static electricity, or lightening strikes. After the assembly is launched, the gates are removed. This is done by unshunting the detonators 416 by operating an initial electrical switch (seen at gate 510), and by further closing electrical switches one by one until an activation signal may pass through the safety circuit 500 and the detonators 416 are active.

In the arrangement of FIG. 5, two physical shunt wires 535 are provided. Initially, the wires 535 are connected across the detonators 416. This connection is external to the perforating gun assembly 402. Wires 535 are visible from the outside of the assembly 402. When the assembly 402 is delivered to the well site, the shunt wires 535 are disconnected from one another and are connected to the detonators 416 and to the circuitry making up the safety system 500.

In operation, a detonation battery 560 is provided for the perforating gun 402. At the appropriate time, the detonation battery 560 delivers an electrical charge to a firing capacitor 566. The firing capacitor 566 then sends a strong electrical signal through one or more electrical lines 535. The lines 535 terminate at the detonators 416 within the perforating gun 402. The electrical signal generates resistive heat, which causes a detonation cord (not shown) to burn. The heating rapidly travels to the shaped charges 412 along the perforating gun 402.

In order to prevent premature actuation, a series of gates is provided. In FIG. 5, a first gate is shown at 510. This first gate 510 is controlled by a mechanical pull tab. The tab is pulled as the perforating gun 402 (and other downhole tool components of tool 402) is dropped into a wellbore. The tab may be pulled manually after the removal of safety pins (not shown). More preferably, the tab is pulled automatically as the gun 402 falls from a wellhead and into the wellbore.

U.S. Ser. No. 61/489,165 describes a perforating gun assembly being released from a wellhead. That application was filed on 23 May 2011, and is entitled "Safety System for Autonomous Downhole Tool." FIG. 8 and the corresponding discussion in that co-pending application are incorporated herein by reference.

When the tab is pulled by the action of gravity upon the tool 402, the first gate 510 is closed. This causes a command signal to be sent, shown as dashed line 512. The signal 512 is sent to a fire enabling timer 514. The timer 514, in turn, controls a second gate in the safety system 500.

Returning to FIG. 5, the second gate in the safety system 500 is shown at 520. This second gate 520 represents a timer. More specifically, the second gate 520 is a timed relay switch that shunts the electrical connections to the detonators 416 at all times unless a predetermined time value is exceeded. In one aspect, the timer 514 represents three or more separate clocks. Logic control compares the times kept by each of the three clocks. The logic control averages the three times. Alternatively, the logic control accepts the time of the two closest times, and then averages them. Alternatively still, the logic control "votes" to select the first two (or other) times of the clock that are the same.

In one aspect, the timer 514 of gate 520 prevents a 2-pole relay 536 from changing state, that is, from shunting the detonators 416 to connecting the detonators 516 to the firing capacitor 566 for a predetermined period of time. The predetermined period of time may be, for example, 1 to 5 minutes. This is a "fire blocked" state. Thereafter, the electrical switch 520 is closed for a predetermined period of time, such as up to 30 minutes or, optionally, up to 55 minutes. This is a "fire unblocked" state.

Preferably, the safety system 500 is also programmed or designed to de-activate the detonators 516 in the case that detonation does not occur within a specified period of time. For instance, if the detonators 416 have not caused the charges 412 to fire after 55 minutes, the electrical switch representing the second gate 520 is opened, thereby preventing the relay 536 from changing state from shunting the detonators 416 to connecting the detonators 416 to the firing capacitor 566. This feature enables the safe retrieval of the gun assembly 402 utilizing standard fishing operations. In any instance, a control signal is provided through dashed line 516 for operating the switch of the second gate 520.

As noted, the control system 500 also includes a third gate 530. This third gate 530 is based upon one or more pressure-sensitive switches. In one aspect, the pressure-sensitive switch 330 is biased by a spring (not shown) to be in the closed (shunted) position. In this manner, the third gate switch 730 is shunted, or closed, during transport and loading. Alternatively, the pressure-sensitive switch is a diaphragms that is designed to puncture or collapse upon exceeding a certain pressure threshold.

In either design, as the gun assembly 402 falls in the wellbore, hydrostatic pressure increases in the wellbore. Once a predetermined pressure value is exceeded within the wellbore, the gate 530 represented by one or more pressure-sensitive electrical switches closes. This provides a time-delayed unshunting of the detonators 416.

In one aspect, the ring (seen in FIG. 8 of U.S. Ser. No. 61/489,165) provides a mechanical barrier for the actuation of the pressure-activated switches of the third gate 530. Thus, the third gate 530 cannot close unless the first gate 510 is closed.

The fourth gate is shown at 540. This fourth gate 540 represents the program or digital logic that determines the location of the gun assembly 402 as it traverses the wellbore. As discussed above and in the incorporated patent application that is U.S. Provisional Pat. Appl. No. 61/424,285 entitled "Method for Automatic Control and Positioning of Autonomous Downhole Tools," the logic processes magnetic readings to identify probable casing collar locations, and compares those locations with a previously-downloaded (and, optionally algorithmically processed) casing collar log. The casing collar locations are counted until the desired location within the wellbore is reached. An electrical signal is then delivered that closes the fourth gate 540.

The fourth gate 540 is preferably an electronics module. The electronics module consists of an onboard memory 542 and built-in logic 544, together forming a controller. The electronic module provides a digital safety barrier based on logic and predetermined values of various tool events. Such events may include tool depth, tool speed, tool travel time, and downhole markers. Downhole markers may be Casing Collar Locator (CCL) signals caused by collars and pup joints intentionally (or unintentionally) placed in the completion string.

In the arrangement of FIG. 5, a signal 518 is sent when the launch switch representing the first gate 510 is closed. The signal 518 informs the controller to begin computing tool depth in accordance with its operational algorithm. The controller includes a detonator control 542. At the appropriate depth, the detonator control 542 sends a first signal 544' to the detonator power supply 560. In one aspect, the detonator power supply 560 is turned on a predetermined number of minutes, such as three minutes, after the tool assembly 402 is launched.

It is noted that in an electrically powered perforating gun, a strong electrical charge is needed to ignite the detonators 516. The power supply (or battery) 560 itself will not deliver that charge; therefore, the power supply 560 is used to charge the firing capacitor 566. This process typically takes about two minutes. Once the firing capacitor 566 is charged, the current lines 535 may carry the strong charge to the detonators 516. Line 574 is provided as a power line.

The controller of the fourth gate 540 also includes a fire control 522. The fire control 522 is part of the logic. For example, the program or digital logic representing the fourth gate 540 locates the perforating zone by matching a reference casing collar log using real time casing collar information acquired as the tool drops down the well. When the perforating gun assembly 402 reaches the appropriate depth, a firing signal 524 is sent.

The fire control 522 is connected to a 2-pole Form C fire relay 536. The fire relay 536 is controlled through a command signal shown at 524. The fire relay 536 is in a shunting of detonators 516 (or safe) state until activated by the fire control 522, and until the command path 524 through the second gate 520 is available. In their safe state, the fire relay 536 disconnects the up-stream power supply 560 and shunts down-stream detonators 516. The relay 536 is activated upon command 524 from the fire control 522.

The control system 500 optionally also includes a battery kill timer 546. The battery kill timer 546 exists in an armed state for, say, up to 60 minutes. When armed, the battery kill timer 546 closes a relay 552 allowing battery pack 554 to power the controller of gate 540. When necessary to kill the batteries 554, 560, battery kill timer 546 opens lower relay 552' and closes upper relay 552". This allows charge from the power supply 560 to begin dissipating. This, in turn, serves as a safety feature for the system 500.

The battery kill timer 546 is also connected to a detonator disconnect relay 572. This is through a command signal 549. The disconnect relay 572 is preferably a magnetically latching relay. Therefore, the relay 572 remains in its last-commanded state even when all electrical power is removed from the system 500.

The relay 572 resides normally in a closed state. However, if the perforating gun 412 fails to fire after a designated period of time, such as 60 minutes, then a command signal 549 is sent and the relay 572 is opened. Opening the relay 572 prevents a firing charge to be delivered from the capacitor 566 to the shunt wires 535, thereby serving as another safety feature for the system 500.

In another arrangement, the detonator disconnect relay 572 resides normally in an open state. When the tool assembly 200 is dropped, the detonator control 542 sends a command signal 543 to close the relay 572, thereby allowing electrical current to flow through the relay 572 and towards the detonators 416. If after a designated period of time, such as 60 minutes, the detonators 416 have not fired, then the battery kill timer 546 sends a separate signal 549 to re-open the relay 572.

In the arrangement of FIG. 5, a command signal 549' is also shown for "disarming" the power supply 560. Redundantly, a separate command signal 549" is optionally directed to the switch 549". In a first designated period of time, such as 1 to 5 minutes, the command signals 549', 549" are dormant. The power supply 560 is inactive and the switch 562 remains open. During a second period of time, such as 4 to 60 minutes, the power supply 560 is activated (through command signal 544' from the detonator control 542) and the switch 562 is closed (through a related command signal 544" from the detonator control 542). During a third designated period of time, such as greater than 30 minutes, or greater than 60 minutes, the power supply 560 is optionally de-activated (using command signal 549').

The controller 216 may be configured to use only one of command signals 549, 549', 549", or any two, or none.

The fifth and final illustrative gate is shown at 550. This fifth gate 550 relates to the installation of a battery pack 554. Power is supplied from the battery pack 554 to the controller of the fourth gate 540 only after the battery pack 554 is installed. Without the controller, the firing capacitor cannot deliver electrical signals through the wires 535 and the detonators 416 cannot be armed. Thus, the battery pack 554 preferably includes a connector that allows the battery pack 554 to be physically disconnected.

It is noted that relay switches 552', 552" may also be magnetically latching relays. As such, the relays 552, 552" maintain their last commanded state after electrical power is removed. Lower relay 552' controls power to the controller 540, while the upper relay 552" is used to discharge the battery 554. In the pre-configured state, both relays 552' and 552" are open. Relay 552" is closed to power up the controller 540. When the battery kill timer 546 commands a battery kill action, the relay 552" is closed by command signal 548. A short time later, relay 552' is commanded to the open state, removing electrical power from the controller 540.

As an optional feature, a discharge bank 554 may be provided to draw down the electrical power stored in the capacitor 535. The discharge bank 554 may be, for example, a bleed-down resistor. The discharge bank 554 eliminates any potential source of long-term energy.

In operation, the battery pack (Gate 5) is installed into the perforating gun 212. The gun 212 is then released into the wellbore. The ring removal (Gate 1) triggers a pressure-activated switch (Gate 2) rated to remove the detonator shunt at a predetermined pressure value. In addition, the ring removal (Gate 1) activates a timed relay switch (Gate 3) that removes another detonator shunt once the pre-set time expires. At this point the detonators 416 are ready to fire and await the activation signal from the control system (the Gate 4 electronics module). The electronics module monitors the depth of the gun assembly 402. After the perforating gun assembly 402 has traveled to a pre-programmed depth, the electronics logic (Gate 4) sends a signal that closes a mechanical relay and initiates detonation.

The safety system 500 may have a built-in safe tool retrieval system in case of misfire. A mechanical relay with a timer may also be activated after the shunt is removed. The timer is programmed to switch the relay after a pre-set period of time has passed, for example, one hour after activation. Once the relay is switched, it shunts the detonators back and locks itself in shunted position. This may be done, for example, by using a magnet. The assembly 402 may be fished out using conventional fishing techniques and the fishing neck.

In the arrangement of FIG. 5, a command signal 544" may be sent to a switch 562. In a first designated period of time, such as 1 to 5 minutes, the switch 562 remains open. During a second period of time, such as 4 to 60 minutes, the switch is closed. And during a third designated period of time, such as greater than 30 minutes, the switch is re-opened.

It is preferred that the autonomous tool be manufactured using non-conductive materials such as ceramic. The use of non-conductive materials increases the safety of the autonomous tool by reducing the risk of stray currents activating the detonators or other tool that is activated in response to an electrical signal.

A fluid-activated shunt switch can also be incorporated into the safety system 500. Such a switch shunts the detonators 416 in the event that water enters inside the electronics module. An illustrative fluid-activated shunt switch is shown and described in connection with FIG. 9 of U.S. Ser. No. 61/489165. FIG. 9 and corresponding text is also incorporated herein by reference.

It is observed that the safety system 500 is applicable not only to autonomous perforating tools, but also to the whipstock assembly 200, the fracturing plug assembly 300, and the fluid delivery assembly 410 described above.

Figure 6:
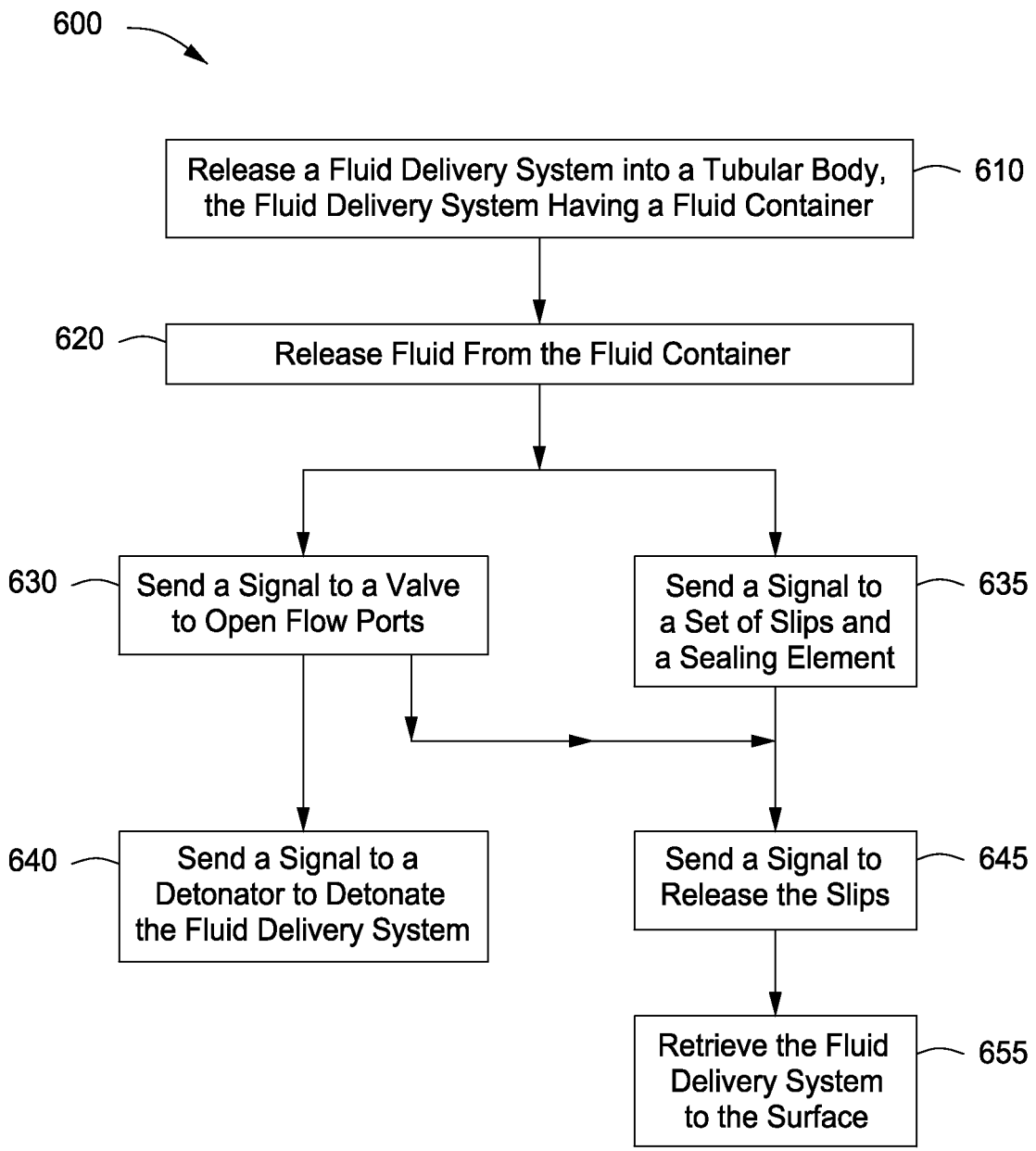
FIG. 6 is a flow chart showing steps for a method of delivering fluid to a subsurface formation in a wellbore, in one embodiment. The method includes the autonomous activation of a set of slips and a valve.

FIG. 6 is a flow chart showing steps for a method 600 of delivering fluid to a subsurface formation, in one embodiment. The method 600 includes the autonomous activation of a fluid conveyance system within a tubular body.

The method 600 first includes releasing a fluid delivery assembly into a tubular body. This is shown in Box 610. The tubular body may be a pipeline containing fluids such as hydrocarbon fluids. Alternatively, the tubular body may be a wellbore having a string of casing along its length. The wellbore may be completed for the purpose of producing hydrocarbons from one or more subsurface formations. Alternatively, the wellbore may be completed for the purpose of injecting fluids into one or more subsurface formations, such as for pressure maintenance or sequestration.

The fluid delivery assembly is designed in accordance with the fluid delivery assembly 410 described above in connection with the FIG. 4 series. In this respect, the fluid delivery assembly includes an elongated fluid container, an actuatable tool, a location device for sensing the location of the autonomous tool within the tubular body based on a physical signature provided along the tubular body, and an on-board controller. The on-board controller is configured to send an actuation signal to an actuatable tool when the location device has recognized a selected location of the autonomous tool based on the physical signature.

In one aspect, the fluid delivery assembly further comprises a set of slips for holding the fluid delivery assembly proximate the selected location. In this instance, the actuatable tool includes the set of slips, such that the set of slips is activated in response to the actuation signal. A setting tool may be used for setting the slips. In another aspect, the fluid delivery assembly also includes an elastomeric sealing element for sealing the tubular body. In this instance, the actuatable tool further comprises the sealing element, such that the sealing element is also activated in response to the actuation signal.

The fluid container, the location device, the actuatable tool, and the on-board controller are together dimensioned and arranged to be deployed in the tubular body as an autonomous unit. A battery pack may also be included for powering the on-board controller.

In the method 600, the fluid container contains a fluid. The method 600 then includes releasing fluid from the fluid container. This is seen at Box 620. Fluid is released at the selected location in response to the actuation signal.

The fluid may be air or other gas loaded into the chamber at substantially atmospheric pressure. In this instance, releasing fluid creates a "burp" of negative pressure within the wellbore. This may be beneficial when a wellbore is first completed. In this respect, the negative pressure will cause a sudden pull of fluids through perforations in the wellbore. This, in turn, will help clean out perforations and fracture tunnels in the near-wellbore region.

Alternatively, the fluid may be a resin. This may be beneficial where the formation is made up of an unconsolidated sand. Here, the resin may be spotted before a fracturing operation takes place, thereby pushing the resin into the formation and along the fracture tunnels.

Alternatively, the fluid may be an acid or a surfactant. This is of benefit, for example, after a wellbore is drilled for cleaning up drilling mud along perforations and fracture tunnels.

Alternatively, the fluid may be a hydrate inhibitor. This is of benefit, for example, after a well has been shut in for a period of time and has entered a cool-down phase.

Alternatively still, the fluid may be a fluid selected to expedite the swelling of a swellable packer. The fluid may have a pH or a salinity or a temperature or other variable that is specially tuned for expediting the swelling.

In one embodiment, the fluid delivery assembly is fabricated from a friable material, such as ceramic. In this instance, the fluid delivery assembly is designed to self-destruct in response to a designated event. Optionally, the fluid delivery assembly includes a detonator for providing the self-destruction. In this instance, destruction of the fluid delivery assembly causes the fluid container to no longer hold fluid, thereby releasing the fluid. In this way, the detonator may actually be the actuatable tool.

In another embodiment, the fluid delivery assembly further includes a valve having one or more ports. The on-board controller sends a signal to open the valve, thereby releasing the fluid. This may be done either with or without stopping the fluid delivery assembly using a set of slips. In the former instance, the method 600 further includes sending a signal to open the valve. This is provided at Box 630.

Along with sending a signal to a valve, the method 600 may optionally include sending a signal to a setting tool for a set of slips and, optionally, a sealing element. This is shown at Box 635. This signal of Box 635 may be sent before, after, or concurrently with sending the signal of Box 630. In this instance, the actuatable tool of the fluid delivery assembly would comprise the valve as well as the setting tool for the slips and the sealing element.

After the valve is opened, the fluid delivery assembly may be detonated. Detonation of the fluid delivery assembly is shown at Box 640. This may be done by a separate signal sent to a detonator. The signal may come from a timer associated with the on-board controller, meaning that the detonator is activated after the passing of a selected period of time. Alternatively, the signal may be an acoustic signal sent through a series of hydraulic pulses from the surface.

In another embodiment, a signal may be sent from the on-board controller to cause the slips of the fluid delivery assembly to release. This alternative step is shown at Box 645. In this instance, the fluid delivery assembly may then be retrieved from the wellbore, such as by pulling the tool using a wireline. Thus, the method 600 may further include retrieving the fluid delivery assembly to the surface. This is indicated at Box 655.

In one embodiment of the method 600, the fluid container contains air, but further includes a solid material. Examples of solid material include a biodegradable diverter, an ignitable material, ball sealers, benzoic acid flakes, particulates, or a cellulosic material.

The method 600 of FIG. 6 is described in terms of using a fluid delivery assembly to deliver fluid to a selected location in a wellbore. The fluid delivery assembly employs a fluid container. However, the delivery assembly may alternatively be a solids delivery assembly. In this arrangement, the assembly uses a canister for holding a solid material. The solid material may be, for example, ball sealers or other solids used for diversion. Alternatively, the solid may be a plug used zonal for isolation, such as benzoic acid flakes, pecan hulls suspended in gel, hair balls, cotton seeds, wood pulp, and innumerable other examples. Alternatively still, the solid may be an ignitable material used for fracturing or stimulation. An example of ignitable material is the progressively burning propellants used by The Gas-Gun, Inc. of Milwaukie, Oreg. Alternatively still, the solid material may be particulates such as sand or ceramic.

One material that may be particularly suited for solids delivery using the delivery assembly described herein is BioVert®. BioVert® is a biodegradable material used by Halliburton as a diverting agent. According to Halliburton literature, BioVert® can be used to provide temporary isolation of newly stimulated perforation clusters within a treatment interval. The perforations receiving the early fluid and proppant volumes of the treatment stages can be temporarily isolated, diverting further treatment to additional sets of perforations. The use of BioVert® as a diverting material is said to facilitate the treatment of longer intervals, thereby reducing the number of perforating runs and frac plugs required.

In delivering solids, the delivery assembly is designed to release the solid material from the canister in response to the release signal. In one aspect, the canister is fabricated from a friable material, and the delivery assembly is constructed to self-destruct in response to the actuation signal. The controller may be programmed to send the release signal before the actuation signal.

In another aspect, the delivery assembly further comprises a perforation gun for perforating a string of casing proximate the selected location. In this instance, one of the at least one actuatable tool comprises the perforating gun, such that perforating charges are fired at the selected location in response to the actuation signal. The controller is programmed to send the release signal before the actuation signal so that ball sealers or other solid is released just before the shaped charges are detonated.

In yet another aspect, the canister is fabricated from a friable material, and destruction of the canister downhole is in response to the actuation signal. This destruction itself causes a release of the solid material such that the actuation signal and the release signal are the same signal.

Figure 7:
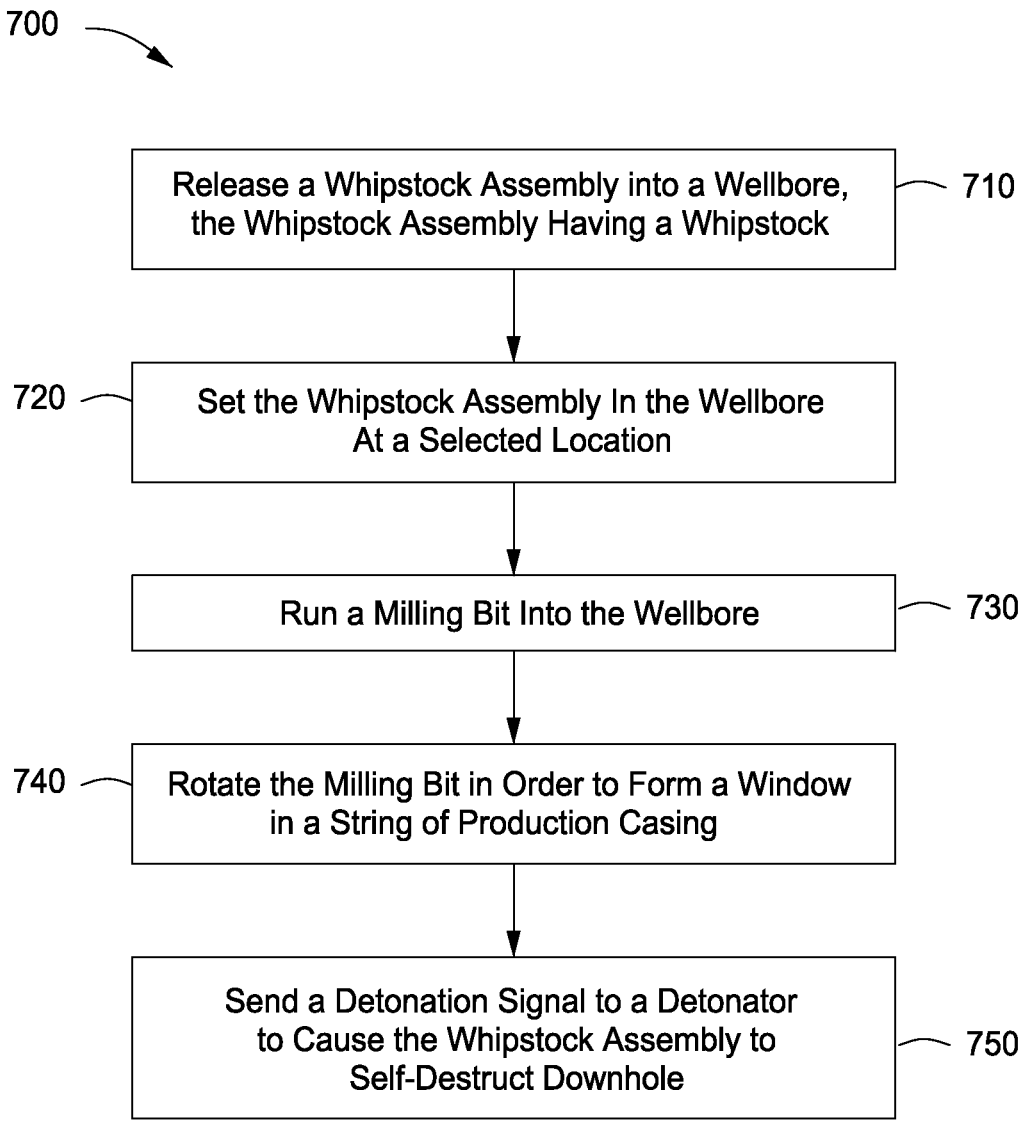
FIG. 7 is a flow chart showing steps for a method of forming a window through a string of casing within a wellbore, in one embodiment. The method includes the autonomous activation of a whipstock assembly within a string of production casing.

FIG. 7 is a flow chart showing steps for a method 700 of forming a window through a string of casing, in one embodiment. The method 700 involves the autonomous activation of a whipstock assembly within a wellbore, and the subsequent formation of a window through a string of production casing.

The method 700 first includes releasing a whipstock assembly into the wellbore. This is shown in Box 710. The whipstock assembly is constructed in accordance with the whipstock assembly 200 discussed above in FIG. 2. In this respect, the whipstock assembly generally includes at least one actuatable tool, a whipstock mechanically connected to the actuatable tool, a location device for sensing the location of the actuatable tool within a wellbore based on a physical signature provided along the wellbore, and an on-board controller. The on-board controller is designed to send an actuation signal to one of the at least one actuatable tool when the location device has recognized a selected location of the actuatable tool based on the physical signature.

In the method 700, the at least one actuatable tool, the whipstock, the location device, and the on-board controller are together dimensioned and arranged to be deployed in the wellbore as an autonomous unit. A battery pack may be included to power the on-board controller. Preferably, the at least one actuatable tool comprises a setting tool and a set of slips. In this instance, the actuation signal causes the setting tool to set the slips in the wellbore at the selected location.

The method 700 also includes setting the whipstock assembly at the selected location. This is seen in Box 720. Setting the whipstock is done in response to the actuation signal, such as by activating the set of slips.

The method 700 further includes running a milling bit into the wellbore. This is provided at Box 730. The milling bit is preferably run in at the end of a string of drill pipe. Alternatively, the milling bit may be part of downhole drilling assembly run in on coiled tubing.

In any event, the method 700 then includes rotating the milling bit in order to form a window through the casing. This is seen at Box 740. Rotating the milling bit may mean rotating a string of drill pipe with the milling bit connected thereto. Alternatively, rotating the milling bit may mean actuating a downhole drilling assembly at then end of coiled tubing. The window is formed adjacent to the whipstock.

In one aspect of the method 700, the at least one actuatable tool comprises a detonator. The method 700 then further comprises sending a detonation signal from the on-board controller to the detonator. This is shown at Box 750. Sending the detonation signal causes the self destruction of the whipstock assembly after the window has been formed.

While it will be apparent that the inventions herein described are well calculated to achieve the benefits and advantages set forth above, it will be appreciated that the inventions are susceptible to modification, variation and change without departing from the spirit thereof.

What is claimed is:

1. A delivery assembly for performing an autonomous tubular operation, comprising:
an elongated canister;
at least one actuatable tool;
a location device for sensing the location of the at least one actuatable tool within a tubular body based on a physical signature provided along the tubular body; and
an on-board controller configured to send an actuation signal to at least one of the at least one actuatable tool when the location device has recognized a selected location of the actuatable tool based on the physical signature;
wherein:
the canister, the location device, and the on-board controller are together dimensioned and arranged to be deployed in the tubular body as an autonomous unit;
the delivery assembly is designed to release a material from the canister in response to a release signal; and
the entire delivery assembly is constructed to self-destruct in response to a self-destruct signal, wherein the on-board controller controls a determined time interval between the actuation signal and the self-destruct signal.

2. The delivery assembly of claim 1, wherein the tubular body is (i) a wellbore constructed to produce hydrocarbon fluids, (ii) a wellbore constructed to inject fluids into a subsurface formation, or (iii) a pipeline containing fluids.

3. The delivery assembly of claim 1, wherein:
the location device is a radio frequency antenna; and
the signature is formed by the spacing of identification tags along the tubular body, with the identification tags being sensed by the radio frequency antenna.

4. The delivery assembly of claim 1, wherein:
the tubular body is a wellbore;
the location device is a casing collar locator; and
the signature is formed by the spacing of collars along the tubular body, with the collars being sensed by the collar locator.

5. The delivery assembly of claim 4, wherein:
the location device comprises a pair of sensing devices spaced apart along the delivery assembly as lower and upper sensing devices;
the controller comprises a clock that determines time that elapses between sensing by the lower sensing device and sensing by the upper sensing device as the delivery assembly traverses across a collar; and
the delivery assembly is programmed to determine delivery assembly velocity at a given time based on the distance between the lower and upper sensing devices, divided by the elapsed time between sensing.

6. The delivery assembly of claim 5, wherein a position of the actuatable tool at the selected location along the wellbore is confirmed by a combination of (i) location of the delivery assembly relative to the collars as sensed by either the lower or the upper sensing device, and (ii) velocity of the delivery assembly as computed by the controller as a function of time.

7. The delivery assembly of claim 4, wherein:
the delivery assembly further comprises a set of slips for holding the location of the delivery assembly proximate the selected location; and
one of the at least one actuatable tool comprises the set of slips, such that the set of slips is activated at the selected location in response to the actuation signal.

8. The delivery assembly of claim 7, wherein:
the delivery assembly further comprises an elastomeric sealing element for sealing the tubular body; and
the actuatable tool further comprises the sealing element, such that the sealing element is also activated at the selected location in response to the actuation signal.

9. The delivery assembly of claim 1, wherein:
the elongated canister is a fluid container; and
the delivery assembly is designed to release fluid from the fluid container in response to a release signal.

10. The delivery assembly of claim 9, wherein:
the fluid container contains a fluid; and
the fluid comprises (i) air loaded into the chamber at substantially atmospheric pressure, (ii) a resin, (iii) an acid, (iv) a surfactant, (v) a hydrate inhibitor, (vi) oxygen, or (vi) a fluid selected to expedite the swelling of a swellable packer.

11. The delivery assembly of claim 10, wherein:
the actuatable tool comprises a detonator, such that activation of the detonator causes a release of fluid from the fluid container at the selected location;
the fluid delivery assembly is fabricated from a friable material;
the fluid delivery assembly is designed to self-destruct in response to a detonation signal sent to the detonator; and
the detonation signal is also the release signal.

12. The delivery assembly of claim 10, wherein:
the fluid container comprises a valve having at least one port;
one of the at least one actuatable tool comprises the valve; and
the valve is configured to open the at least one port in response to the release signal sent from the on-board controller.

13. The delivery assembly of claim 12, wherein:
the fluid container is fabricated from a friable material.

14. The delivery assembly of claim 13, wherein the controller is programmed to send the release signal before the actuation signal.

15. The delivery assembly of claim 13, wherein:
destruction of the canister causes a release of the fluid such that the actuation signal and the release signal are the same signal.

16. The delivery assembly of claim 1, wherein:
the material in the elongated canister comprises substantially solid material; and
the delivery assembly is designed to release the solid from the canister in response to the release signal.

17. The delivery assembly of claim 16, wherein:
the canister is fabricated from a friable material.

18. The delivery assembly of claim 17, wherein destruction of the canister causes a release of the solid material such that the actuation signal and the release signal are the same signal.

19. The delivery assembly of claim 16, wherein the controller is programmed to send the release signal before the actuation signal.

20. The delivery assembly of claim 19, wherein:

the delivery assembly further comprises a perforation gun for perforating a string of casing proximate the selected location;

one of the at least one actuatable tool comprises the perforating gun, such that perforating charges are fired at the selected location in response to the actuation signal; and the controller is programmed to send the release signal before the actuation signal.

21. The delivery assembly of claim 19, wherein the solid material comprises ball sealers that are dimensioned to seal perforations.

22. The delivery assembly of claim 1, further comprising:

a battery pack; and a multi-gate safety system for preventing premature activation of the at least one actuatable tool, the safety system comprising control circuitry having one or more electrical switches that are independently operated in response to separate conditions before permitting the actuation signal to reach the tool.

23. The delivery assembly of claim 22, wherein the multi-gate safety system comprises at least one of:

(i) a selectively removable battery pack, wherein the control circuitry is configured to operate an electrical switch when the battery pack is installed into the assembly;

(ii) a mechanical pull-tab, wherein the control circuitry is configured to operate an electrical switch upon removal of the tab from the fluid delivery assembly;

(iii) a pressure-sensitive switch that is configured to operate an electrical switch only when a designated hydraulic pressure on the fluid delivery assembly is exceeded;

(iv) an electrical timer switch that is configured to operate only a designated period of time after deployment of the fluid delivery assembly in the wellbore;

(v) a velocity sensor configured to operate an electrical switch only upon sensing that the fluid delivery assembly is traveling a designated velocity; and (vi) a vertical sensor configured to operate an electrical switch when the fluid delivery assembly is substantially vertical;

wherein operating an electrical switch means either closing such a switch to permit a flow of electrical current through the switch and toward the actuatable tool, or opening such a switch to restrict a flow of electrical current through the switch and toward the actuatable tool.

24. A method for delivering fluid to a subsurface formation, comprising:

releasing a fluid delivery assembly into a wellbore, the fluid delivery assembly comprising:

an elongated fluid container containing a fluid, at least one actuatable tool;

a location device for sensing the location of the at least one actuatable tool within a tubular body based on a physical signature provided along the tubular body, and an on-board controller configured to send an actuation signal to at least one of the at least one actuatable tool when the location device has recognized a selected location of the actuatable tool based on the physical signature;

wherein the fluid container, the location device, the at least one actuatable tool, and the on-board controller are together dimensioned and arranged to be deployed in the wellbore as an autonomous unit and the fluid delivery assembly is constructed to entirely self-destruct in response to a self-destruct signal;

releasing fluid from the fluid container at the selected location in response to a release actuation signal; and controlling a determined time interval between the actuation signal and the self-destruct signal with the controller.

25. The method of claim 24, wherein:

the location device is a radio frequency antenna; and the signature is formed by the spacing of identification tags along the tubular body, with the identification tags being sensed by the radio frequency antenna.

26. The method of claim 24, wherein:

the location device is a collar locator; and the signature is formed by the spacing of casing collars along the wellbore, with the collars being sensed by the collar locator.

27. The method of claim 26, wherein:

the location device comprises a pair of sensing devices spaced apart along the fluid delivery assembly as lower and upper sensing devices;

the signature is formed by the placement of tags spaced along the wellbore that are sensed by each of the sensing devices;

the controller comprises a clock that determines time that elapses between sensing by the lower sensing device and sensing by the upper sensing device as the fluid delivery assembly traverses across a tag; and the fluid delivery assembly is programmed to determine fluid delivery assembly velocity at a given time based on the distance between the lower and upper sensing devices, divided by the elapsed time between sensing.

28. The method of claim 27, wherein a position of the fluid delivery assembly at the selected location along the wellbore is confirmed by a combination of (i) location of the fluid delivery assembly relative to the tags as sensed by either the lower or the upper sensing device, and (ii) velocity of the fluid delivery assembly as computed by the controller as a function of time.

29. The method of claim 24, wherein:

the fluid delivery assembly is fabricated from a friable material.

30. The method of claim 29, wherein the at least one actuatable tool comprises a detonator, such that activation of the detonator causes the self-destruction of the fluid container; and a release of fluid from the fluid container at the selected location.

31. The method of claim 29, wherein:

the release signal serves to open a valve, thereby releasing fluid from the fluid container at the selected location; and the release signal is sent prior to the another actuation signal.

32. The method of claim 24, wherein:

the fluid delivery assembly further comprises a set of slips for holding the location of the fluid delivery assembly proximate the selected location;

the actuatable tool comprises the set of slips, such that the set of slips is activated in response to the actuation signal.

33. The method of claim 32, wherein:

the fluid delivery assembly further comprises an elastomeric sealing element for sealing the tubular body; and the actuatable tool further comprises the sealing element, such that the sealing element is also activated in response to the actuation signal.

34. The method of claim 32, further comprising:

sending a signal to release the slips; and retrieving the fluid delivery assembly from the wellbore.

35. The method of claim 34, wherein sending a signal comprises (i) sending an electrical signal from the on-board controller, or (ii) sending an acoustic signal through hydraulic pulses delivered from a surface.

36. The method of claim 24, wherein the fluid comprises (i) air loaded into the chamber at substantially atmospheric pressure, (ii) a resin, (iii) an acid, (iv) a surfactant, (v) a hydrate inhibitor, (vi) oxygen, or (vii) a fluid selected to expedite the swelling of a swellable packer.

37. The method of claim 24, wherein:

the fluid container comprises a valve having at least one flow port;

one of the at least one actuatable tool comprises the valve; and the method further comprises activating the valve to open the at least one flow port in response to the release signal to release the fluid from the fluid container.

38. The method of claim 37, wherein:

the fluid container is fabricated from a friable material; and the fluid delivery assembly is constructed to self-destruct at the time, or a designated period of time after, the at least one flow port has been opened.

39. The method of claim 37, wherein:

the on-board controller is part of an electronic module comprising onboard memory and built-in logic; and the electronic module is configured to send a signal that initiates detonation of the detonator after the valve has been opened.

40. The method of claim 39, wherein the built-in logic provides a digital safety barrier based on a predetermined value for (i) assembly depth, (ii) assembly speed, (iii) travel time, (iv) downhole markers, or (v) combinations thereof.

41. The method of claim 24, wherein the fluid delivery assembly further comprises:

a battery pack; and a multi-gate safety system for preventing premature activation of the actuatable tool, the safety system comprising control circuitry having one or more electrical switches that are independently operated in response to separate conditions before permitting the actuation signal to reach the tool.

42. The method of claim 41, wherein the multi-gate safety system comprises at least one of:

(i) a selectively removable battery pack, wherein the control circuitry is configured to operate an electrical switch when the battery pack is installed into the assembly;

(ii) a mechanical pull-tab, wherein the control circuitry is configured to operate an electrical switch upon removal of the tab from the fluid delivery assembly;

(iii) a pressure-sensitive switch that is configured to operate an electrical switch only when a designated hydraulic pressure on the fluid delivery assembly is exceeded;

(iv) an electrical timer switch that is configured to operate only a designated period of time after deployment of the fluid delivery assembly in the wellbore;

(v) a velocity sensor configured to operate an electrical switch only upon sensing that the fluid delivery assembly is traveling a designated velocity; and (vi) a vertical sensor configured to operate an electrical switch when the fluid delivery assembly is substantially vertical;

wherein operating an electrical switch means either closing such a switch to permit a flow of electrical current through the switch and toward the actuatable tool, or opening such a switch to restrict a flow of electrical current through the switch and toward the actuatable tool.

43. The method of claim 24, wherein the fluid comprises a solid material.

44. The method of claim 43, wherein the solid material comprises at least one of a biodegradable diverter, an ignitable material, ball sealers, benzoic acid flakes, particulates, and a cellulosic material.

* * * * *